US008960893B2

(12) United States Patent
Iljima

(10) Patent No.: US 8,960,893 B2
(45) Date of Patent: Feb. 24, 2015

(54) CONVEYING APPARATUS AND IMAGE RECORDING APPARATUS

(71) Applicant: Shota Iljima, Nagoya (JP)

(72) Inventor: Shota Iljima, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/850,822

(22) Filed: Mar. 26, 2013

(65) Prior Publication Data

US 2014/0092186 A1 Apr. 3, 2014

(30) Foreign Application Priority Data

Sep. 28, 2012 (JP) ..... 2012-218642

(51) Int. Cl.
*B41J 11/06* (2006.01)
*B41J 13/02* (2006.01)
*B41J 11/00* (2006.01)

(52) U.S. Cl.
CPC ..... *B41J 13/02* (2013.01); *B41J 11/006* (2013.01); *B41J 13/025* (2013.01)
USPC ..... 347/104

(58) Field of Classification Search
CPC ..... B41J 13/0352
USPC ..... 347/104
See application file for complete search history.

(56) References Cited

U.S. PATENT DOCUMENTS 7,748,710 B2 * 7/2010 Terada ..... 271/272
2006/0268292 A1 11/2006 Takeuchi

FOREIGN PATENT DOCUMENTS

| | | | |
|---|---|---|---|
| JP | 9183546 | A | 7/1997 |
| JP | 2005153147 | A | 6/2005 |
| JP | 2005263332 | A | 9/2005 |
| JP | 2006327804 | A | 12/2006 |
| JP | 2007118301 | A | 5/2007 |
| JP | 2007268862 | A | 10/2007 |

* cited by examiner

*Primary Examiner* — Julian Huffman
*Assistant Examiner* — Sharon A Polk
(74) *Attorney, Agent, or Firm* — Banner & Witcoff, Ltd.

(57) ABSTRACT

The disclosure relates generally to a conveying apparatus and an image recording apparatus including the conveying apparatus. The conveying apparatus may include a plurality of first rollers and a second roller configured to form a nip point with each of the first rollers so that a sheet may be conveyed. The conveying apparatus may also include a roller holder configured to support the first roller and allow the plurality of first rollers to move toward and away from the second roller. The roller holder may include a shaft pressing portion configured to press shafts of the first rollers, and a sliding portion configured to move in a width direction between a third position and a fourth position to cause the shaft pressing portion to move between a first position and a second position, respectively.

20 Claims, 16 Drawing Sheets

BACK
FRONT
LEFT
RIGHT
UP
DOWN
B
B'
7
8
9
62
64
66
67
68
71
72
73
74
75
76(72)
78
82
84
85
86
87
88
89
90
91
92
93
96
97

BACK
FRONT
LEFT
RIGHT
UP
DOWN
B
B'
8
9
7
64
62
63
66
67
68
71
72
73
74
75
76(72)
78
82
84
85
86
87
88
89
90
91
92
93
96
97

UP
DOWN
LEFT
RIGHT
FRONT
BACK

CONVEYING APPARATUS AND IMAGE RECORDING APPARATUS

CROSS-REFERENCE TO RELATED APPLICATIONS

This application claims priority from Japanese Patent Application No. 2012-218642, filed on Sep. 28, 2012, which is incorporated herein by reference in its entirety.

TECHNICAL FIELD

The present invention relates to a conveying apparatus, having roller pairs that hold a medium and convey the medium, that can change a nip pressure of the roller pair and can move one roller of the roller pair toward and away from the other roller, and to an image recording apparatus, having the conveying apparatus, that can record an image on the medium.

BACKGROUND

When, for example, a conveying apparatus conveys a sheet-like medium, the conveying apparatus brings one roller of a roller pair into pressure contact with the other roller. When conveying a medium (e.g., a compact disc (CD) or a digital versatile disc (DVD) thicker than a sheet-like medium, the conveying apparatus makes a pressing force exerted by one roller to the other roller, that is, the nip force of the roller pair, less than when a sheet-like medium is conveyed. Alternatively, the conveying apparatus moves one roller away from the other roller.

In another example, in a state in which a conveying path is not jammed with a sheet, the conveying apparatus brings one roller of the roller pair into pressure contact with the other roller. In a state in which there is a sheet jam, the conveying apparatus makes a pressing force exerted by one roller to the other roller less than a pressing force in the state in which there is no sheet jam. Alternatively, when there is a sheet jam, the conveying apparatus may move one roller away from the other roller. Thus, the user of the image recording apparatus can easily clear the sheet jam.

As an example of the image recording apparatus having the conveying apparatus as described above, an image recording apparatus is known that can move a spur away from a sheet discharge roller by vertically moving a spur holder that holds the spur.

SUMMARY

In the known type of image recording apparatus, however, the spur holder holding the spur is larger and heavier than the spur. Accordingly, if the image recording apparatus vertically moves a large spur, the size of the image recording apparatus is enlarged. Furthermore, much power is required to vertically move the large spur.

Accordingly, aspects described herein provide for a conveying apparatus that can change a pressing force exerted by one roller of a roller pair on the other roller or can move one roller without having to move an entire large holder that holds a roller such as a spur and to provide an image recording apparatus having the conveying apparatus.

In one or more examples, a conveying apparatus including a plurality of first rollers spaced from each other with respect to a width direction orthogonal to a conveyance direction, each of the first rollers comprising a respective shaft is disclosed. The conveying apparatus may include a second roller configured to form a nip point with each of the first rollers and to convey the sheet in the conveyance direction. The conveying apparatus may also include a roller holder configured to support the first roller and allow the plurality of first rollers to move toward and away from the second roller. The roller holder may include a shaft pressing portion configured to move between a first position in which the shaft pressing portion presses one or more of the shafts of the plurality of first rollers toward the second roller, and a second position in which a pressing force of the shaft pressing portion acting on the one or more shafts of the plurality of first rollers is less than a pressing force of the shaft pressing portion acting on the one or more shafts of the plurality of first rollers when the shaft pressing portion is located in the first position. The roller holder may also include a sliding portion configured to come into contact with the shaft pressing portion and move in the width direction between a third position and a fourth position. Further, when the sliding portion moves from the third position to the fourth position, the pressing portion may move from the first position to the second position. Additionally, when the sliding portion moves from the fourth position to the third position, the pressing portion may move from the second position to the first position.

According to the aspects of the disclosure, the conveying apparatus may be included within an image recording apparatus. The image recording apparatus may include a recording portion configured to record an image on the sheet to be conveyed by the first rollers and the second roller. The image recording apparatus may further include a second urging member that urges the sliding portion toward the third position. The recording portion may further include a recording head that ejects ink droplets toward the medium and a carriage on which the recording head is mounted, wherein the carriage is configured to move in the width direction. Moreover, the carriage may cause the sliding portion to move from the third position to the fourth position.

This summary is not intended to identify critical or essential features of the inventions claimed herein, but instead merely summarizes certain features and variations thereof. Other objects, features, and advantages will be apparent to persons of ordinary skill in the art from the following detailed description of the disclosure and the accompanying drawings.

DESCRIPTION OF THE DRAWINGS

Some features herein are illustrated by way of example, and not by way of limitation, in the figures of the accompanying drawings in which like reference characters refer to similar elements.

DETAILED DESCRIPTION OF EXAMPLE EMBODIMENTS

Figure 1:
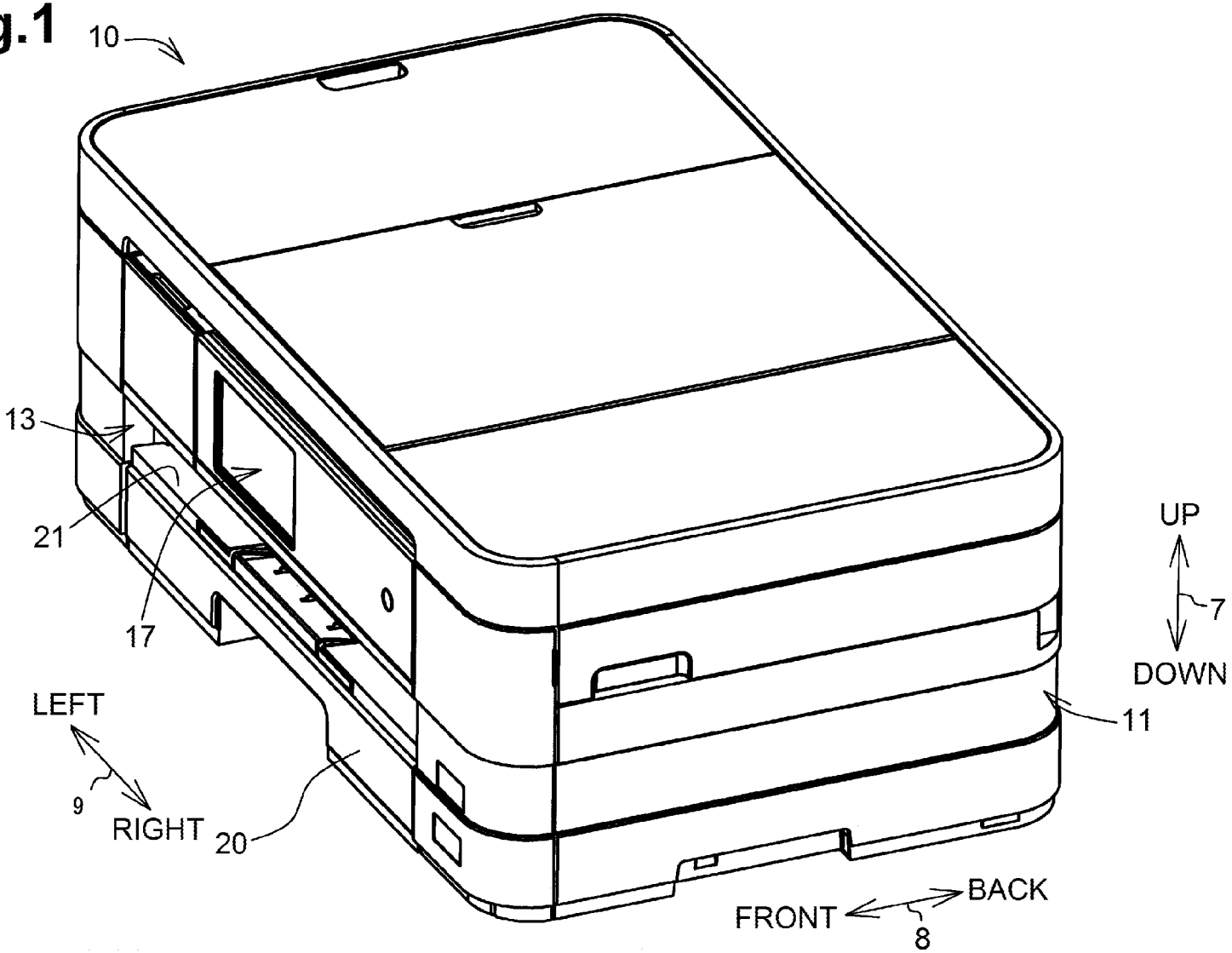
FIG. 1 is a perspective view illustrating an external appearance of an all-in-one machine in an illustrative embodiment according to one or more aspects of the disclosure.

Illustrative embodiments according to one or more aspects are described below with reference to the accompanying drawings. The illustrative embodiments described below are only examples. Various changes, arrangements and modifications may be applied therein without departing from the spirit and scope of the disclosure. In the description below, an up-down direction 7 is defined with respect to a state depicted in FIG. 1, in which an all-in-one machine 10 (an example of an image recording apparatus) is installed so as to be ready to use, a front-back direction 8 is defined by taking a side on which an opening 13 is formed as the near side (front), and a right-left direction 9 is defined when the all-in-one machine 10 is viewed from the near side (front).

As depicted in FIG. 1, the all-in-one machine 10, formed in a substantially rectangular parallelepiped shape, may have a printer unit 11 at a lower portion. The printer unit 11 records an image on recording sheet 12 (see FIG. 2) in an inkjet recording method. The printer unit 11 is not limited to the inkjet recording method. The printer unit 11 may record an image on the recording sheet 12 in, for example, an electrophotographic method. The all-in-one machine 10 may have a facsimile function, a printing function, and various other functions.

The printer unit 11 may have an opening 13 at the front. A feed tray 20, on which the recording sheet 12 in various sizes can be inserted into and removed from the opening 13 in the front-back direction 8. A discharge tray 21 is provided on the feed tray 20 so as to be placed on the feed tray 20. The discharge tray 21 is inserted into and removed from the opening 13 together with the feed tray 20.

Figure 2:
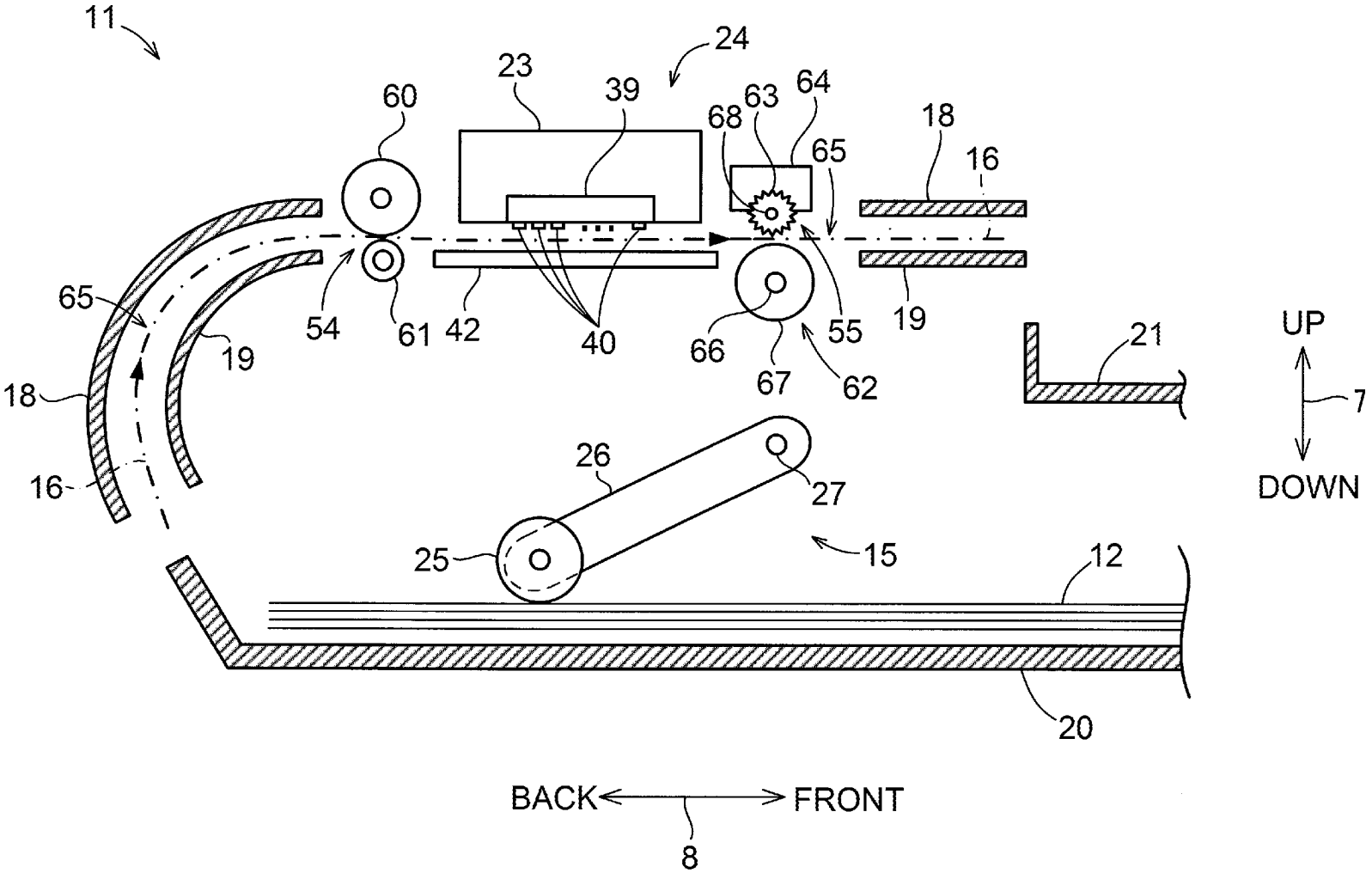
FIG. 2 is a longitudinal cross-sectional view illustrating the internal structure of a printer in an illustrative embodiment according to one or more aspects of the disclosure.

As depicted in FIG. 2, the printer unit 11 has a feeding unit 15 that picks up the recording sheet 12 from the feed tray 20 and feeds the picked-up recording sheet 12, a recording unit 24, provided above the feed tray 20, that records an image on the recording sheet 12 that has been fed by the feeding unit 15, and a conveying apparatus. The conveying apparatus has conveying roller pairs 54 and discharge roller pairs 55 that convey the recording sheet 12, and a spur moving mechanism 64 that vertically moves spurs 63 of the discharge roller pairs 55. The above constituent elements of the printer unit 11 will be described later.

As depicted in FIG. 2, the feeding unit 15 is disposed above the feed tray 20 inserted into the opening 13 (see FIG. 1) formed in the printer unit 11. The feeding unit 15 has a feed roller 25, a feed arm 26, and a shaft 27.

The feed roller 25 is rotatably disposed at an end of the feed arm 26. The feed roller 25 is rotated as a result of a driving force from a feeding motor (not shown). To rotate the feed roller 25, the feed roller 25 may be driven by a conveying motor 102 (see FIG. 3) described later.

The feed arm 26 is rotatably attached to the shaft 27, which is supported to a main body frame (not shown) of the printer unit 11. The feed arm 26 is rotatably urged toward the feed tray 20 by its own weight or by an elastic force given by a spring or the like. When rotated, the feed roller 25 picks up the recording sheet 12 placed on the feed tray 20 and feeds the picked-up recording sheet 12 to a conveying path 65 described later.

As depicted in FIG. 2, the conveying path 65 extends from the back end of the feed tray 20, curves upward and toward the front of the all-in-one machine 10, and further extends from a rear side (back side) of the all-in-one machine 10 toward its front side. The conveying path 65 passes a holding position at which the recording sheet 12 is held by the conveying roller pair 54, passes under the recording unit 24, passes a holding position at which the recording sheet 12 is held by the discharge roller pair 55, and communicates with the discharge tray 21. The recording sheet 12 that has been fed from the feed tray 20 is guided through the conveying path 65 so as to be upwardly U-turned from below and is further guided to the recording unit 24. After an image has been recorded on the recording sheet 12 by the recording unit 24, the recording sheet 12 is guided to the discharge tray 21. Specifically, the recording sheet 12 is conveyed along a conveyance direction 16 indicated by the dash-dot line indicated in FIG. 2. The conveying path 65 is formed with an outer guide member 18 and an inner guide member 19, which are mutually opposite with a fixed space therebetween.

As depicted in FIG. 2, in the conveying path 65, the conveying roller pair 54 having a conveying roller 60 and a pinch roller 61 is disposed upstream of the recording unit 24 in the conveyance direction 16. The conveying roller 60 and pinch roller 61 may contact each other. The pinch roller 61 is brought into pressure contact with the conveying roller 60 by, for example, a spring.

In the conveying path 65, the discharge roller pair 55 having a discharge roller 62 (an example of a second roller) and a spur 63 (an example of a first roller) is disposed downstream of the recording unit 24 in the conveyance direction 16.

Figure 3A:
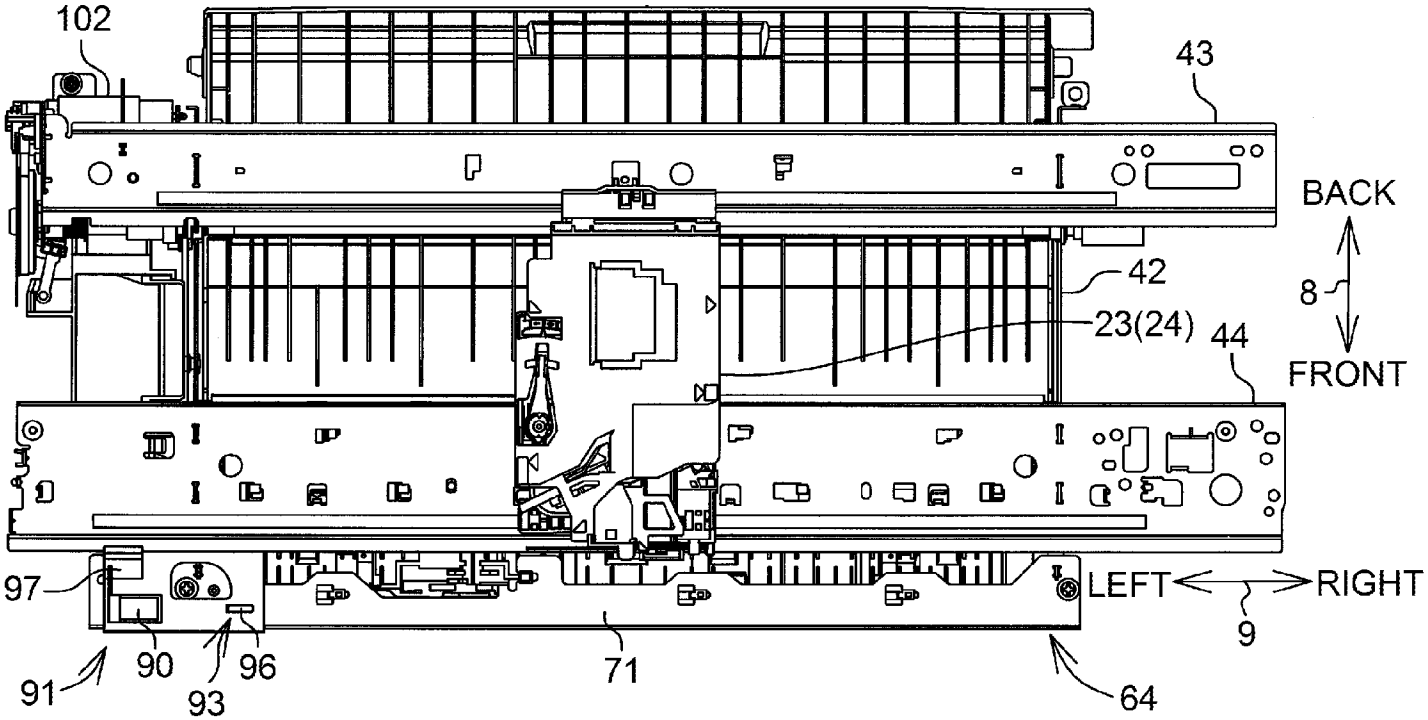
FIG. 3A is a plan view of a carriage, a platen, guide rails, and a spur moving mechanism.
Figure 3B:
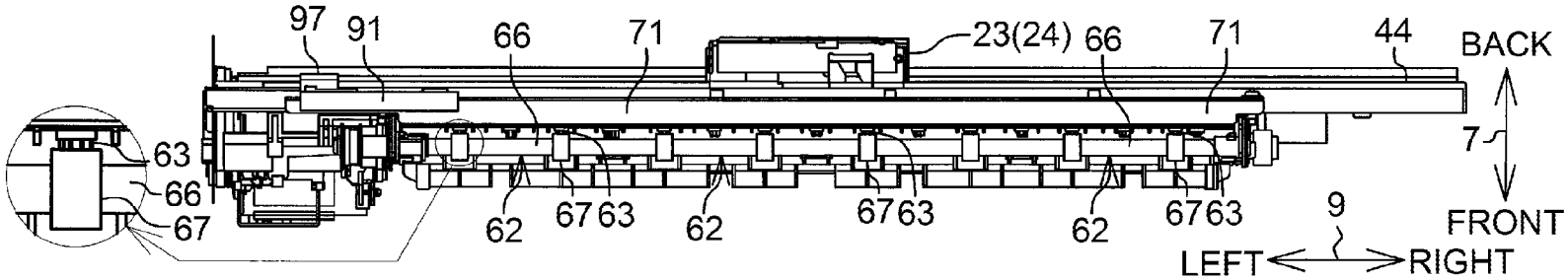
FIG. 3B is a front view of a carriage, a platen, guide rails, and a spur moving mechanism in an illustrative embodiment according to one or more aspects of the disclosure.
Figure 4:
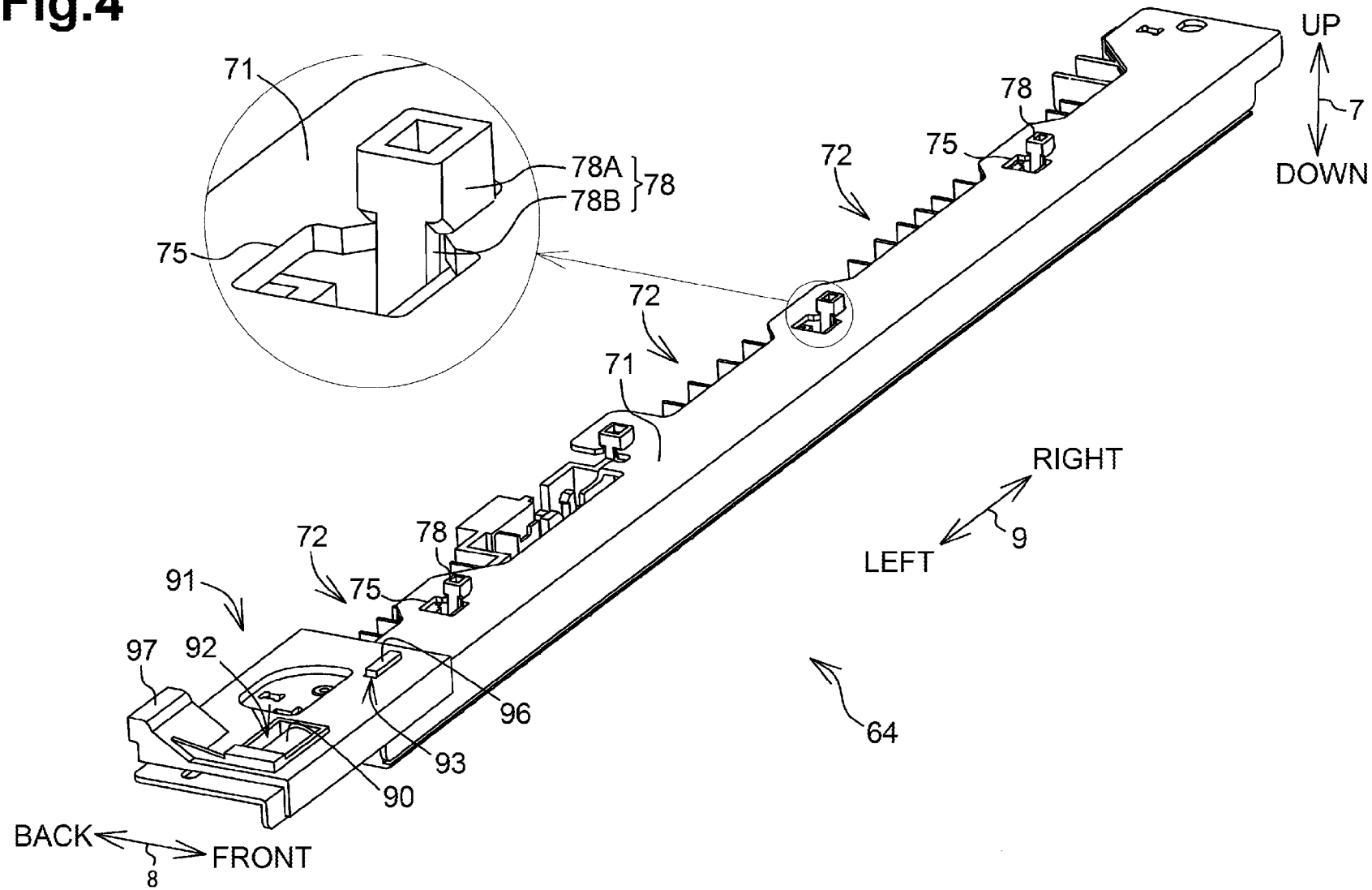
FIG. 4 is a perspective view of a spur moving mechanism when viewed from above at an angle in an illustrative embodiment according to one or more aspects of the disclosure.

As depicted in FIG. 3B, the discharge roller 62 has a single shaft 66 extending in the right-left direction 9 and a plurality of roller portions 67 attached to the shaft 66. The plurality of roller portions 67 may be evenly spaced apart along the shaft 66.

Figure 6A:
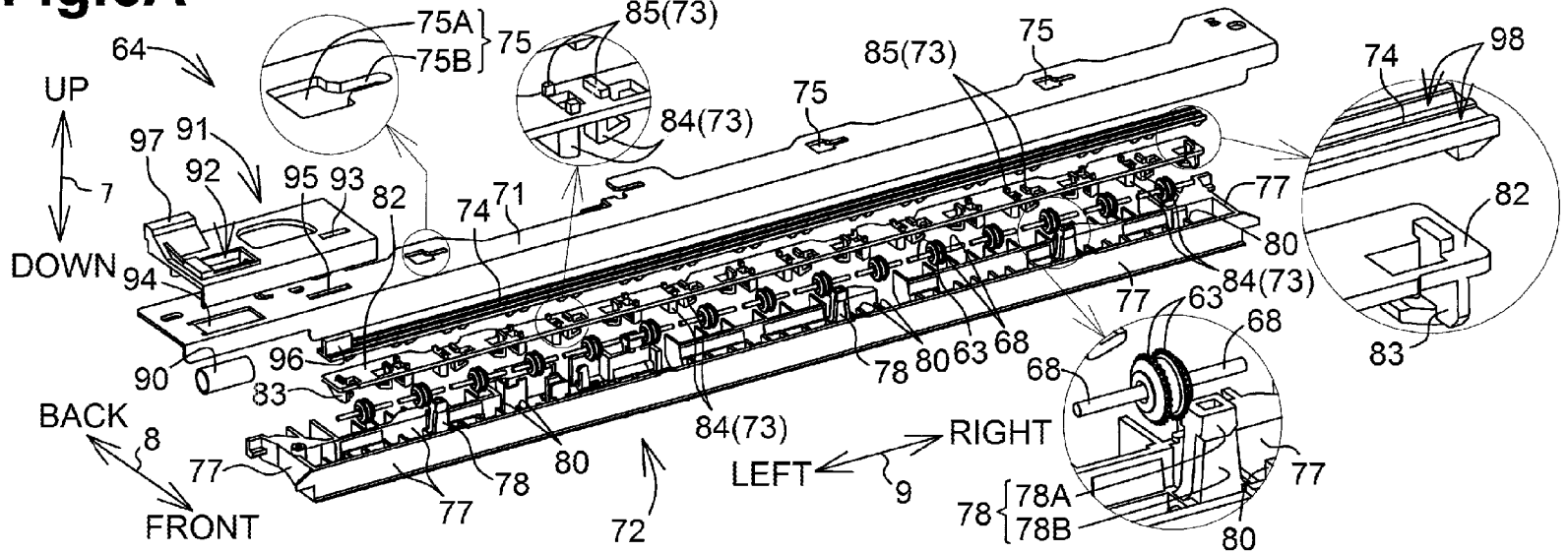
FIGS. 6A and 6B are exploded perspective views of the spur moving mechanism in an illustrative embodiment according to one or more aspects of the disclosure.
Figure 6B:
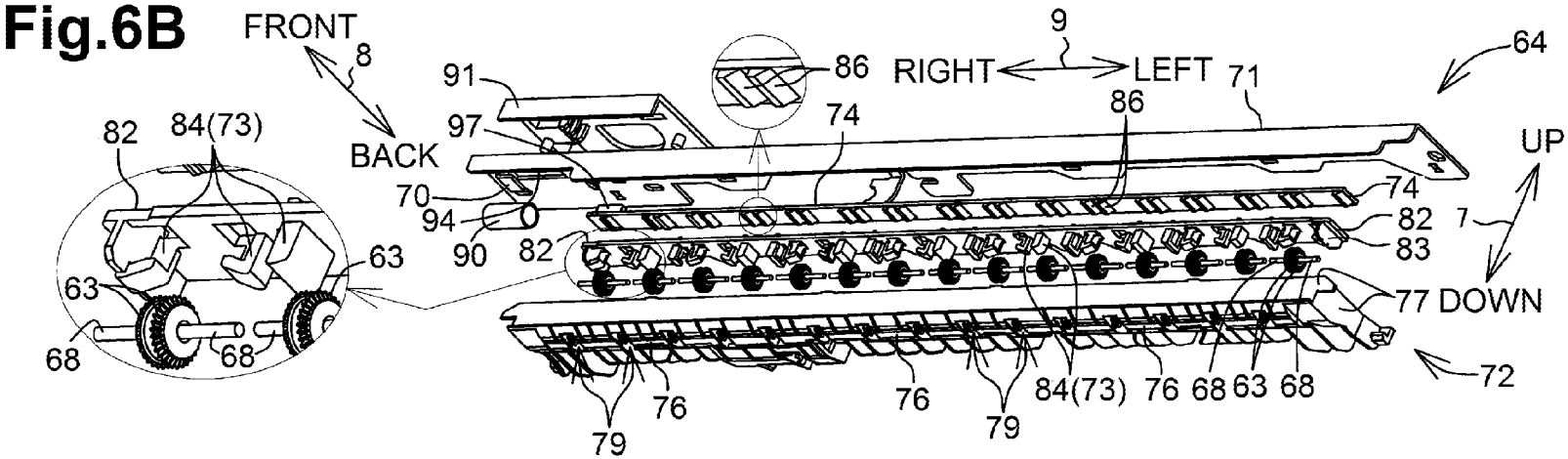

As depicted in FIGS. 6A and 6B, a plurality of spurs 63 are spaced in the right-left direction 9. A shaft 68 (an example of an elastic shaft) passes through each spur 63. Thus, the shaft 68 extends from both sides of each spur 63 in the right-left direction 9. A single shaft 68 is provided for a single spur 63. The spur 63 is at the center of the shaft 68 in the right-left direction 9.

The shaft 68 may be formed with a bar-like spring. One spur 63 is disposed above each of the plurality of roller portions 67 constituting the discharge roller 62 so as to face the roller portion 67. The spur 63 can be urged (or pressed) by a spring that is part of the shaft 68 toward the roller portion 67. That is, the spur 63 and discharge roller 62 can be brought into pressure contact.

The conveying roller 60 and discharge roller 62 are rotated by being given a driving force from the conveying motor 102 (see FIG. 3). The pinch roller 61 is rotated by being driven by the rotation of the conveying roller 60. The spur 63 is rotated by being driven by the rotation of the discharge roller 62. Thus, the conveying roller pair 54 and discharge roller pair 55 hold the recording sheet 12 and convey it through the conveying path 65 in the conveyance direction 16. The spur 63 may contact the recording sheet 12 when the recording sheet 12 is being held by the discharge roller pair 55.

As depicted in FIG. 2, a platen 42 is provided below the conveyance path 65 between the conveying roller pair 54 and the discharge roller pair 55. The platen 42 supports the recording sheet 12, which is conveyed through the conveying path 65 by the conveying roller pairs 54 and discharge roller pairs 55, from below.

The recording unit 24 is disposed at the upper portion of the conveying path 65 so as to face the platen 42. The recording unit 24 has a carriage 23 and a recording head 39. As depicted in FIG. 3A, the carriage 23 is supported by a guide rail 43 disposed at the back of the platen 42 and a guide rail 44 disposed at its front. Both ends of the guide rails 43 and 44 in the right-left direction 9 are attached to the main body (not shown) of the printer unit 11. At least one of the guide rails 43 and 44 has a belt mechanism (not shown). The carriage 23 is linked to the belt mechanism. The belt mechanism is driven by a carriage driving motor (not shown). Thus, the carriage 23 can move bidirectionally in the right-left direction 9.

As depicted in FIG. 2, the recording head 39 is mounted in the carriage 23. The recording head 39 has a plurality of nozzles 40 on the lower surface. Ink is supplied from an ink cartridge (not shown) to the recording head 39. The recording head 39 ejects ink supplied from the nozzles 40 as ink droplets. While the carriage 23 is moving bidirectionally in the right-left direction 9, ink droplets are ejected from the nozzles 40 toward the recording sheet 12 held by the platen 42. Thus, an image is recorded on the recording sheet 12.

Figure 5:
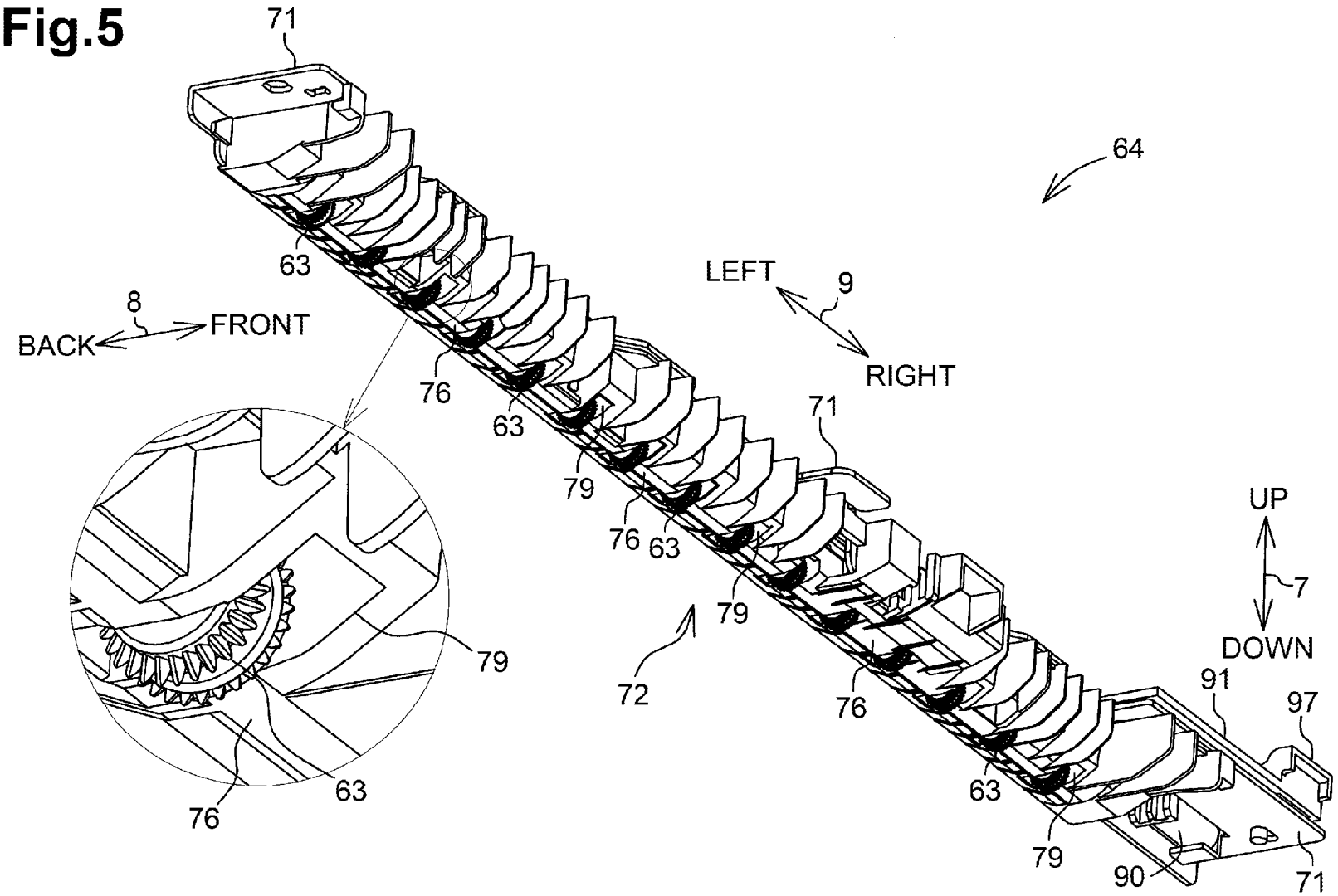
FIG. 5 is a perspective view of the spur moving mechanism when viewed from below at an angle in an illustrative embodiment according to one or more aspects of the disclosure.

As depicted in FIG. 2, the spur moving mechanism 64 (an example of a roller holder) is disposed so as to cover the spurs 63 from above. As depicted in FIG. 5, the spurs 63 are covered by the spur moving mechanism 64 with their lower circumference surfaces exposed. As depicted in FIG. 4 to FIGS. 6A and 6B, the spur moving mechanism 64 has a frame 71, a lower cover 72, shaft pressing portions 73, and a sliding portion 74.

As depicted in FIG. 4 to FIGS. 6A and 6B, the frame 71 is a substantially plate-like member with a thickness in the up-down direction 7. The length of the frame 71 in the right-left direction 9 is longer than its length in the front-back direction 8. That is, the frame 71 extends in the right-left direction 9. Both ends of the frame 71 in the right-left direction 9 are attached to the main body frame (not shown) of the printer unit 11.

The front end of the frame 71 may bend downwardly. The frame 71 may have at least one opening 75. In this embodiment, three openings 75 are formed in the right-left direction 9 with a spacing between each two openings 75. The opening 75 is formed with a first opening 75A and a second opening 75B, which is contiguous to the first opening 75A; the second opening 75B has a shorter length in the front-back direction 8 than the first opening 75A (see FIG. 6A). A projection 78 formed on the bottom plate 76 of the lower cover 72 is inserted into each opening 75 (see FIG. 4). The lower cover 72 will be described later.

As depicted in FIG. 4 to FIGS. 6A and 6B, the lower cover 72 (an example of a roller housing) may be attached to the lower side of the frame 71. As depicted in FIGS. 6A and 6B, in addition to the bottom plate 76, the lower cover 72 has side plates 77 erected upwardly at the front end, rear end, right end, and left end of the bottom plate 76. The projection 78 is formed at a position, on the bottom plate 76, opposite to one opening 75 in the frame 71 so as to be erected upwardly. The projection 78 has a top end 78A and a bottom end 78B, which has a shorter length in the front-back direction 8 than the top end 78A. The projection 78 is inserted from the first opening 75A of the opening 75, after which the lower cover 72 is slid to the right. Thus, the top end 78A of the projection 78 is located at the top of the second opening 75B of the opening 75. The length of the top end 78A in the front-back direction 8 is longer than the length of the second opening 75B in the front-back direction 8. Thus, the lower cover 72 is attached to the lower side of the frame 71 (see FIG. 4).

As depicted in FIGS. 5 and 6B, a plurality of openings 79 may be formed in the bottom plate 76 in the right-left direction 9 with a spacing between each two openings 79. The length of the opening 79 in the front-back direction 8 is longer than the diameter of the spur 63. The length of the opening 79 in the right-left direction 9 is longer than the thickness of the spur 63. The spur 63 is placed on the bottom plate 76 so as to be immediately above the opening 79. Thus, the lower end of the spur 63 is inserted into the opening 79 and is exposed to the lower end of the bottom plate 76.

Figure 9:
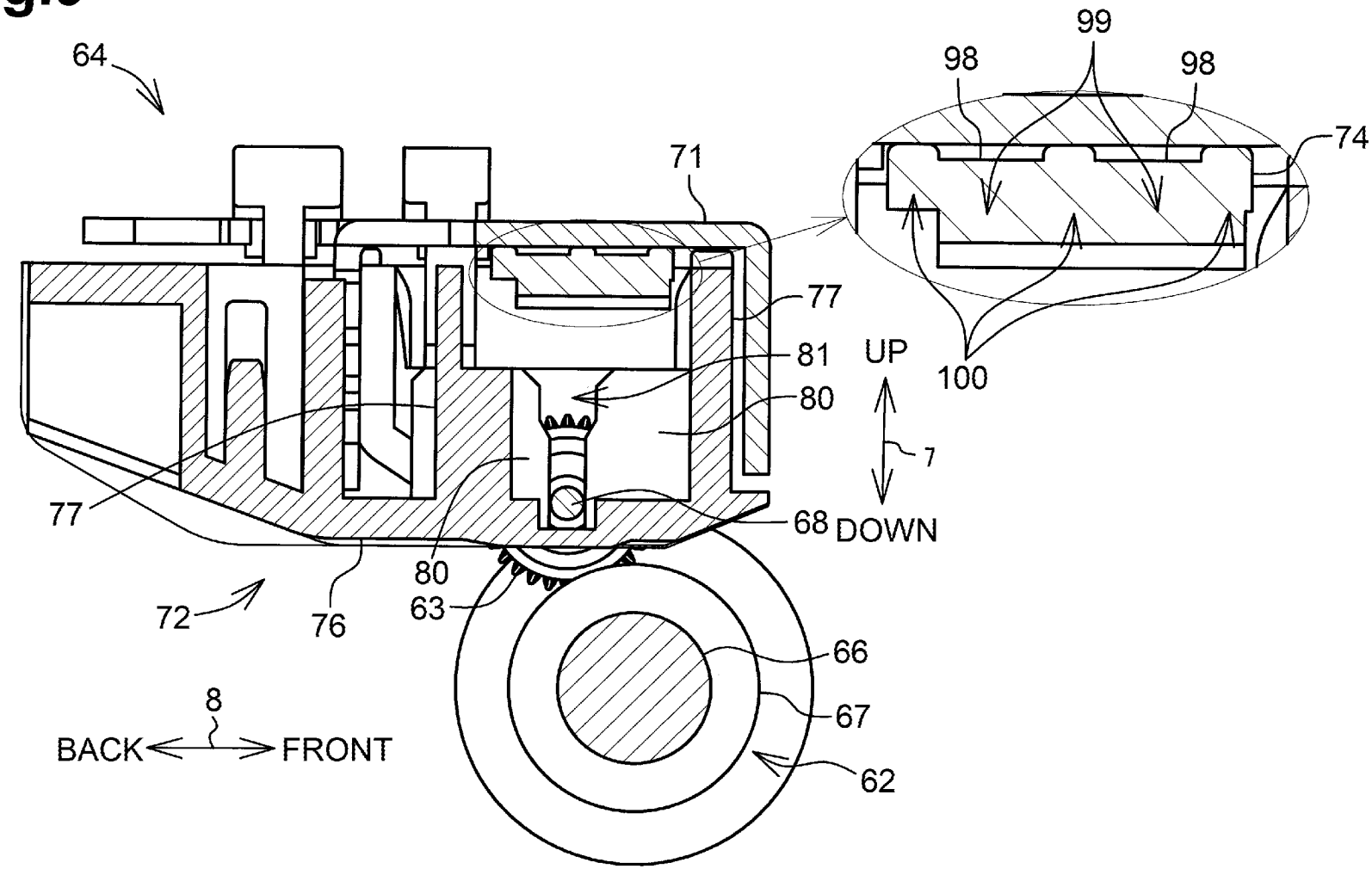
FIG. 9 is a cross-sectional view of the spur moving mechanism as taken when the spur moving mechanism is cut at a position at which a slit in an orthogonal direction is visible in an illustrative embodiment according to one or more aspects of the disclosure.

As depicted in FIG. 6A, a plurality of ribs 80 may be erected upwardly on the bottom plate 76. The plurality of ribs 80 spaced from each other in the right-left direction 9. One spur 63 is disposed between a pair of adjacent ribs 80 of the plurality of ribs 80. As depicted in FIG. 9, ribs 80 at both sides of the spur 63 have a slit 81 (an example of a bearing) that extends downwardly from the top end, that is, in the up-down direction 7. The width of the slit 81 is longer the diameter of the shaft 68 of the spur 63 so that the shaft 68 is engageably inserted into the slit 81 downwardly from above. Thus, the shaft 68 enters a state in which it is inserted into the slit 81 in the right-left direction 9. Since the slit 81 extends in the up-down direction 7, the spur 63 can move in the up-down direction 7. As described above, the discharge roller 62 is disposed below the spur 63. That is, the spur 63 is attached to the lower cover 72 so as to be movable in the up-down direction 7 in which the spur 63 moves toward and away from the discharge roller 62.

As described above, the side plates 77 may be erected upwardly at the front end, rear end, right end, and left end of the bottom plate 76. That is, the side plates 77 are erected so as to enclose all of the plurality of spurs 63. In other words, the side plates 77 are erected from the bottom plate 76 outside all of the plurality of spurs 63.

As depicted in FIGS. 6A and 6B, the shaft pressing portion 73 may be disposed above the shaft 68 of the spur 63 and below the frame 71. The shaft pressing portion 73 may be attached to a plate-like member 82, the thickness direction of which may match the up-down direction 7. The shaft pressing portion 73 may be formed integrally with the plate-like member 82.

The plate-like member 82 may be a substantially plate-like member having a length in the right-left direction 9 that is longer than a length in the front-back direction 8. The length of the plate-like member 82 in the front-back direction 8 is shorter than the spacing in the front-back direction 8 between the side plate 77 erected at the front end of the lower cover 72 and the side plate 77 erected at its rear end. The length of the plate-like member 82 in the right-left direction 9 is shorter than the spacing in the right-left direction 9 between the side plate 77 erected at the right end of the lower cover 72 and the side plate 77 erected at its left end. The plate-like member 82 is placed in a spacing enclosed by the side plates 77 of the lower cover 72. That is, all of the plurality of shaft pressing portions 73 may be enclosed by the side plates 77 of the lower cover 72. In other words, the side plates 77 are erected from the bottom plate 76 outside all of the plurality of shaft pressing portions 73.

As depicted in FIGS. 6A and 6B, one shaft pressing portion 73 may be disposed at a position opposite to the shaft 68 on the right side of each of the plurality of spurs 63, and another one shaft pressing portion 73 may be disposed at a position opposite to the shaft 68 on the left side of the spur 63. That is, two shaft pressing portions 73 are disposed for each of the plurality of spurs 63.

As depicted in FIGS. 6A and 6B to FIGS. 8A to 8C, the shaft pressing portion 73 has a lower projection 84 and an upper projection 85. Also, the shaft pressing portion 73 may be attached to the plate-like member 82. The lower projection 84 may extend downwardly from the lower surface of the plate-like member 82 and the upper projection 85 may extend upwardly from the upper surface of the plate-like member 82. The top of the lower projection 84 may contact the shaft 68 of the spur 63 from above (see FIGS. 7B and 8B). The top of the upper projection 85 may contact the sliding portion 74, which will be described later in detail, from above (see FIGS. 7B and 8B).

The shaft pressing portion 73 and plate-like member 82 may be attached to the lower cover 72 in a state in which they are movable in a direction along the side plate 77 of the lower cover 72 (in the up-down direction 7). The shaft pressing portion 73 is pressed from above by the sliding portion 74, which is movable in the right-left direction 9, as described later. When moving in the right-left direction 9, the sliding portion 74 switches between a state in which it presses the shaft pressing portion 73 and a state in which it does not press the shaft pressing portion 73, as described later.

While being pressed by the sliding portion 74, the shaft pressing portion 73 may press the shaft 68 of the spur 63 downwardly, that is, toward the discharge roller 62. As described above, the shaft 68 is formed with a bar-like spring. At some points in time, the lower side of the spur 63 may contact the discharge roller portion 67, and the shaft 68 might not be supported from below by any other member. Accordingly, when pressed, the shaft 68 may move downward so as to move the spur 63 downwardly. In some examples, the shaft 68 may be elastic and may bend so as to move the spur 63 downwardly. In practice, since the discharge roller 62 is present below the spur 63, the spur 63 is pressed against the discharge roller 62 (see FIG. 7B). At that time, the shaft pressing portion 73 is at the first position. In this embodiment, when the shaft pressing portion 73 is at the first position, it contacts the lower cover 72. That is, the shaft pressing portion 73 at the first position is supported by the lower cover 72.

Figures 8A, 8B, 8C:
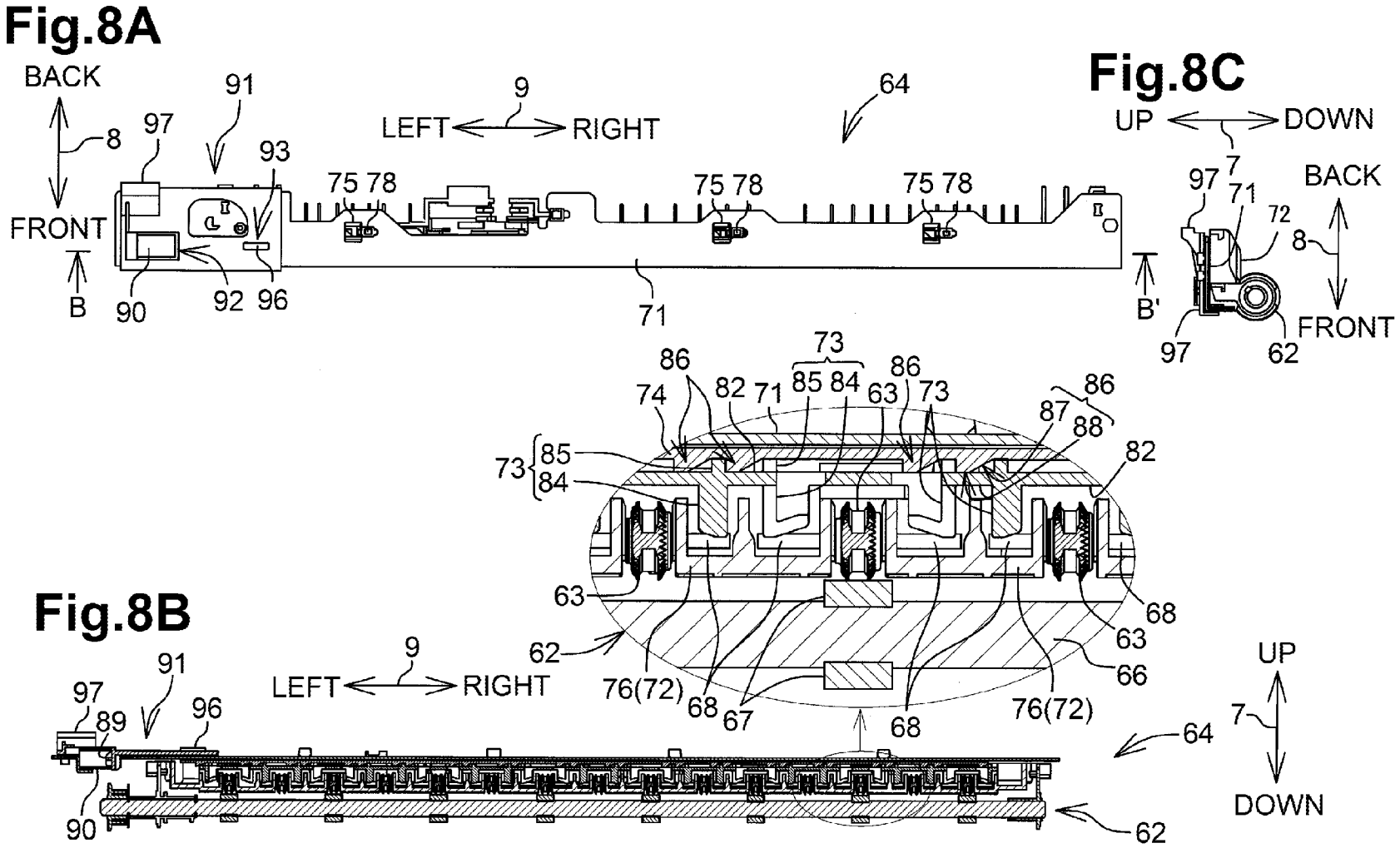
FIG. 8A is a plan view of the spur moving mechanism when the shaft pressing unit is at a second position.
FIG. 8B is a cross-sectional view as taken along line B-B' in FIG. 8A.
FIG. 8C is a right side view of the spur moving mechanism in an illustrative embodiment according to one or more aspects of the disclosure.

In this embodiment, while the shaft pressing portion 73 is not being pressed by the sliding portion 74, a force with which the shaft pressing portion 73 presses the shaft 68 of the spur 63 may be reduced in spite of the shaft pressing portion 73 contacting the shaft 68 of the spur 63 (see FIG. 8B). At that time, the shaft pressing portion 73 is at the second position. Thus, the shaft pressing portion 73 moves to the first position at which the shaft pressing portion 73 presses the shaft 68 of the spur 63 and to the second position at which the force with which the shaft pressing portion 73 presses the shaft 68 of the spur 63 is smaller than at the first position. The lower sides of the spur 63 and shaft 68 may contact the discharge roller 62 and their upper sides may contact the shaft pressing portion 73, so the spur 63 and shaft 68 are held at appropriate positions.

As depicted in FIGS. 6A and 6*b*, projections 83 extending downwardly may be formed at both ends of the plate-like member 82. In a state in which the plate-like member 82 is disposed so as to be enclosed by the side plates 77, each projection 83 is inserted between ribs 80 erected from the bottom plate 76. This restricts the movement of the plate-like member 82 and shaft pressing portions 73 in the right-left direction 9.

As depicted in FIGS. 6A and 6B, the sliding portion 74 may be disposed above the shaft pressing portions 73 and below the frame 71. The sliding portion 74 may be a substantially plate-like member with a thickness in the up-down direction 7. The length of the sliding portion 74 in the right-left direction 9 may be longer than its length in the front-back direction 8. The length of the sliding portion 74 in the front-back direction 8 may be shorter than the spacing in the front-back direction 8 between the side plate 77 erected at the front end of the lower cover 72 and the side plate 77 erected at its rear end. The length of the sliding portion 74 in the right-left direction 9 may be shorter than the spacing in the right-left direction 9 between the side plate 77 erected at the right end of the lower cover 72 and the side plate 77 erected at its left end. The sliding portion 74 is placed in a spacing enclosed by the side plates 77 of the lower cover 72. That is, as with the shaft pressing portions 73, the sliding portion 74 may be enclosed by the side plates 77 of the lower cover 72. As described later, each convex portion 86 formed on the lower surface of the sliding portion 74 contacts its corresponding shaft pressing portion 73 and the upper surface of the plate-like member 82. The upper surface of the sliding portion 74 contacts the frame 71. That is, the sliding portion 74 is attached to the lower cover 72 in a state in which the sliding portion 74 contacts the frame 71.

The sliding portion 74 may be supported by the ribs 80 erected from the bottom plate 76 of the lower cover 72. Since, as described above, the length of the sliding portion 74 in the right-left direction 9 may be shorter than the spacing in the right-left direction 9 between the side plate 77 erected at the right end of the lower cover 72 and the side plate 77 erected at its left end, the sliding portion 74 can move in the right-left direction 9. In this embodiment, the sliding portion 74 can move in the right-left direction 9 between a third position indicated in FIG. 7B and a fourth position, indicated in FIG. 8B, which is to the left of the third position.

Figures 7A, 7B, 7C:
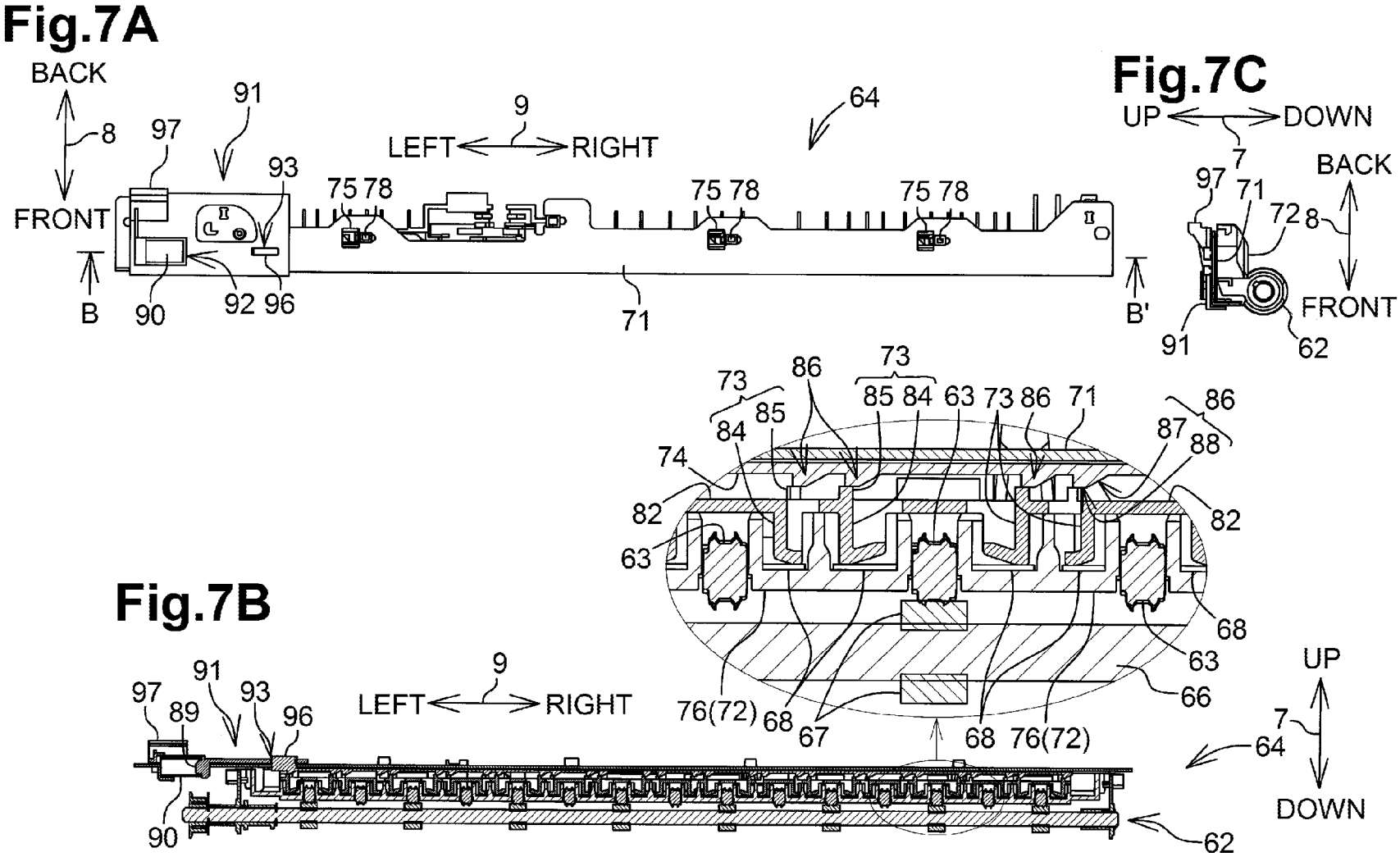
FIG. 7A is a plan view of the spur moving mechanism when a shaft pressing unit is at a first position.
FIG. 7B is a cross-sectional view as taken along line B-B' in FIG. 7A.
FIG. 7C is a right side view of the spur moving mechanism in an illustrative embodiment according to one or more aspects of the disclosure.

As depicted in FIGS. 6B, 7B, and 8B, the convex portions 86 (an example of contacting portions) may be formed on the lower surface of the sliding portion 74. Each convex portion 86 may be configured such that when the sliding portion 74 is at the third position, described later, the convex portions 86 can face the upper projections 85 on the corresponding shaft pressing portion 73. That is, the convex portion 86 may protrude toward the shaft pressing portion 73. The convex portion 86 has a first contacting surface 87, which is inclined downwardly from the lower surface of the sliding portion 74 at an angle, and also has a second contacting surface 88, which is contiguous to the first contacting surface 87 and is below the first contacting surface 87, that is, near the shaft pressing portion 73. The second contacting surface 88 expands in the front-back direction 8 and in the right-left direction 9.

When the sliding portion 74 is at the third position indicated in FIG. 7B, the second contacting surface 88 of each convex portion 86 on the sliding portion 74 may contact the upper projection 85 on the corresponding shaft pressing portion 73 (see FIG. 7B). In this state, the lower projection 84 on the shaft pressing portion 73 presses the shaft 68 of the spur 63. At that time, the shaft pressing portion 73 is at the first position, as described above.

When the sliding portion 74 moves from the position indicated in FIG. 7B to the left, the convex portion 86 of the sliding portion 74 may be released from the upper projection 85 on the shaft pressing portion 73. Specifically, the first contacting surface 87 of the convex portion 86, which moves to the left, first contacts the upper projection 85. As the sliding portion 74 moves to the left, the upper projection 85 moves upwardly by being guided by the first contacting surface 87, which is an inclined surface. Finally, as depicted in FIG. 8B, the convex portion 86 is released from the upper projection 85.

In a state in which the convex portion 86 on the sliding portion 74 is released from the upper projection 85 on the shaft pressing portion 73 (see FIG. 8B), the lower surface of the sliding portion 74 other than the convex portions 86 might not press the upper projection 85. Accordingly, although the lower projection 84 on the shaft pressing portion 73 contacts the shaft 68 of the spur 63, the force with which the lower projection 84 presses the shaft 68 of the spur 63 may be reduced. The position of the sliding portion 74 indicated in FIG. 8B is the fourth position described above. At that time, the shaft pressing portion 73 is at the second position, as described above.

Accordingly, the sliding portion 74 may move to the third position and fourth position. The convex portion 86 may be configured such that it contacts the shaft pressing portion 73 when the sliding portion 74 is at the third position but does not contact the shaft pressing portion 73 when the sliding portion 74 is at the fourth position.

As depicted in FIGS. 6A and 9, two concave portions 98, which extend in the right-left direction 9, may be formed in the upper surface of the sliding portion 74. The concave portions 98 may be formed in the lower surface of the sliding portion 74. Thus, the thickness (length in the up-down direction 7) of a portion (thick portion 100) of the sliding portion 74 where the concave portions 98 are not formed is larger than a portion (thin portion 99) of the sliding portion 74 where the concave portions 98 are formed. In other words, as depicted in FIG. 9, the sliding portion 74 has the thin portion 99, which is thin, and the thick portion 100, the thickness of which is larger than the thickness of the thin portion 99, in the right-left direction 9.

It suffices for the concave portion 98, that is, the thin portion 99, to be formed at the same position as a portion at which at least the sliding portion 74 and shaft pressing portion 73 mutually contact in the front-back direction 8, specifically, a portion at which the convex portion 86 (see FIG. 6B) is formed. That is, the convex portion 86 may be formed in the thin portion 99 at a position to contact the shaft pressing portion 73. Further, the sliding portion 74 may be positioned against the frame 71 to reduce (or prevent) the sliding portion 74 from becoming deformed. As a result, it is possible to improve precision with which the spur 63 is positioned by the sliding portion 74 through the shaft pressing portion 73 because the spur 63 is positioned with respect to the frame 71. In this embodiment, the concave portion 98 is formed from the right end of the sliding portion 74 to its left end in the front-back direction 8.

As depicted in FIG. 4 and FIGS. 6A and 6B to FIGS. 8A and 8B, a coil spring 90 (an example of a second urging member) may be attached to the left end of the sliding portion 74. The coil spring 90 may urge the sliding portion 74 from the fourth position toward the third position, that is, to the right. The coil spring 90 is disposed in the right-left direction 9. The right end of the coil spring 90 is attached to a pressed member 91 (specifically, to an attachment portion 89 of the pressed member 91 (see FIGS. 7B and 8B)), described later, which can move in the right-left direction 9. The left end of the coil spring 90 is attached to the frame 71 (specifically, to an attachment portion 70 of the frame 71 (see FIG. 6B)).

The pressed member 91 may be a substantially plate-like member placed on the upper surface of the frame 71 at its left end. The lower surface of the pressed member 91 may contact the frame 71. That is, the pressed member 91 may be supported by the frame 71. The pressed member 91 has an opening 92 and a slit 93.

The opening 92 may be formed at the left end of the pressed member 91. The attachment portion 89 may be disposed below the right edge of the opening 92 (see FIGS. 7B and 8B). The right end of the coil spring 90 is attached to the attachment portion 89. The frame 71 has an opening 94, which is longer than the opening 92 in the right-left direction 9, immediately below the opening 92 (see FIG. 6A). Since the opening 94 is longer than the opening 92 in the right-left direction 9, the pressed member 91 can move in the right-left direction 9 as described later with the frame 71 fixed.

The slit 93 may be formed at the right end of the pressed member 91. The slit 93 has a shape extending in the right-left direction 9. A slit 95, which is longer than the slit 93 in the right-left direction 9, may be formed immediately below the slit 93 in the frame 71. The sliding portion 74 also has a convex portion 96 disposed on the sliding portion 74 at a position immediately below the slit 93 and slit 95 so that the convex portion 96 may protrude upwardly through the slit 93 and slit 95. The length of the convex portion 96 in the right-left direction 9 may be substantially the same as the length of the slit 93 in the right-left direction 9, but may be shorter than the length of the slit 95 in the right-left direction 9. The length of the convex portion 96 in the front-back direction 8 is substantially the same as the lengths of the slit 93 and slit 95 in the front-back direction 8. Accordingly, the convex portion 96 is fitted to the slit 93 through the slit 93. As a result, when the pressed member 91 moves in the right-left direction 9, the sliding portion 74 also can move in the right-left direction 9 while the frame 71 remains attached to the main body frame, that is, the frame 71 remains fixed.

The pressed member 91 may have a convex portion 97, which extends upwardly, behind the opening 92. The right surface of the convex portion 97 contacts the carriage 23 (see FIG. 3), which moves in the right-left direction 9. When the carriage 23 moves to the left and contacts the convex portion 97 and the convex portion 97 is thereby pressed to the left, the coil spring 90 is compressed and the pressed member 91 moves to the left against the urging force of the coil spring 90. Accordingly, the sliding portion 74, which is fitted to the pressed member 91, also moves to the left, that is, from the third position to the fourth position. As described above, when pressed by the carriage 23, which is moved by the pressed member 91, the sliding portion 74 moves from the third position to the fourth position against the urging force of the coil spring 90.

When the carriage 23, which has been pressing the pressed member 91, moves to the right, the pressed member 91 may move to the right, that is, from the fourth position to the third position, due to a force with which the coil spring 90 is restored from the compressed state to the original state, that is, the urging force of the coil spring 90.

In a state in which the carriage 23 is separated from the convex portion 97 of the pressed member 91 (state depicted in FIGS. 3A and 3B), the sliding portion 74 may be at the third position and the shaft pressing portion 73 may be at the first position as depicted in FIG. 7B. With the shaft pressing portion 73 at the first position, the upper projection 85 of the shaft pressing portion 73 is pressed downwardly by the second contacting surface 88 of the sliding portion 74. That is, the shaft pressing portion 73 is pressed downwardly by the sliding portion 74. Thus, the lower projection 84 of the shaft pressing portion 73 presses the shaft 68 of the spur 63. As a result, the spur 63, which has been pressed downwardly, presses the discharge roller 62.

When the carriage 23 moves to the left and presses the convex portion 97 of the pressed member 91, the pressed member 91 may move to the left. Thus, the sliding portion 74 may also move to the left, that is, from the third position to the fourth position. Then, the shaft pressing portion 73 moves from the first position to the second position. Specifically, the upper projection 85 of the shaft pressing portion 73 is separated from the second contacting surface 88 and then from the first contacting surface 87 and is finally separated from the lower surface of the sliding portion 74. That is, the upper projection 85 shifts from the state in FIG. 7B to the state in FIG. 8B. At that time, the shaft pressing portion 73 is no longer pressed downwardly by the sliding portion 74. This reduces the force with which the lower projection 84 of the shaft pressing portion 73 presses the shaft 68 of the spur 63. As a result, the force with which the spur 63 presses the discharge roller 62 is reduced. That is, the force with which the spur 63 presses the discharge roller 62 when the shaft pressing portion 73 is at the second position is smaller than when the shaft pressing portion 73 is at the first position.

When the carriage 23 moves to the right with the sliding portion 74 being at the fourth position, the pressed member 91 may move to the right due to the urging force of the coil spring 90. Thus, the sliding portion 74 may also move to the right, that is, from the fourth position to the third position. Then, the shaft pressing portion 73 moves from the second position to the first position. Specifically, the upper projection 85 of the shaft pressing portion 73 is pressed by the first contacting surface 87, moves downwardly, and finally contacts the second contacting surface 88. That is, the shaft pressing portion 73 is pressed downwardly by the sliding portion 74. The lower projection 84 of the shaft pressing portion 73 thereby presses the shaft 68 of the spur 63. As a result, the spur 63, which has been pressed downwardly, presses the discharge roller 62.

In the illustrative embodiment, when the sliding portion 74 moves in the right-left direction 9 from the third position to the fourth position, this embodiment can reduce the force with which the spur 63 presses the discharge roller 62. In this embodiment, when the force with which the spur 63 presses the discharge roller 62 is reduced as described above, only the shaft pressing portion 73 and sliding portion 74 are moved and the entire spur moving mechanism 64 is not moved. Accordingly, it is possible to reduce power required to reduce the force with which the spur 63 presses the discharge roller 62. Accordingly, this embodiment can change the force with which the spur 63 presses the discharge roller 62 without having to move the lower cover 72, which supports the spurs 63, and the frame 71, to which the lower cover 72 is attached. Further, because the sliding portion 74 may move in the width direction instead of in a vertical direction, it is possible to suppress the size of the all-in-one machine 10 in which the conveying apparatus is mounted from being enlarged in the vertical direction.

In this embodiment, when the sliding portion 74 is at the third position, the convex portion 86 may press the shaft pressing portion 73, which then presses the shaft 68 of the spur 63. This enables the spur 63 to press the discharge roller 62. When the sliding portion 74 is at the fourth position, the convex portion 86 may be separated from the shaft pressing portion 73, so the convex portion 86 does not press the shaft pressing portion 73. Accordingly, the force with which the shaft pressing portion 73 presses the shaft 68 of the spur 63 can be reduced.

In this embodiment, the frame 71 may be fixed to the all-in-one machine 10 in which the conveying apparatus is mounted, so the frame 71 may be used as a reference according to which the spurs 63 are positioned in the conveying apparatus. The sliding portion 74 is placed in a state in which it contacts the frame 71. By placing the sliding portion 74 in a state in which it contacts the frame 71, the frame 71 may help to reduce (or prevent) the thin portions 99 of the sliding portion 74 from becoming deformed. Thus, although the convex portions 86 of the sliding portion 74 are formed on the thin portion 99, the positional precision between the convex portions 86 and the shaft pressing portion 73, which presses the spur 63, may be increased.

In this embodiment, the spurs 63 and shaft pressing portions 73 may be covered with the bottom plate 76 and side plates 77. Accordingly, this embodiment can reduce the risk that the user externally touches the spur 63 and shaft pressing portion 73, which change the state of the spur 63 with respect to the discharge roller 62, thereby causing the spur 63 and shaft pressing portion 73 to become damaged. For example, the bottom plate 76 and side plates 77 may protect the spurs 63 and shaft pressing portions 73 when a user attempts to remove a paper jam.

This embodiment can also suppress a positional displacement of the spur 63 in the conveyance direction 16. The slit 81 may be configured to have a width that is larger than the diameter of the shaft 68 of the spur 63 in accordance with a predetermined degree of tolerance (which may vary in the various embodiments). However, it should be understood that when the width of the slit 81 is brought close to the diameter of the shaft 68 of the spur 63, the positional precision of the spur 63 in the conveyance direction 16 can be increased.

When the carriage 23 attached to the recording unit 24 moves, this embodiment can move the sliding portion 74. Accordingly, in this embodiment, a special motor does not need to be provided separately to move the sliding portion 74.

As described above, the shaft pressing portion 73 may move in the up-down direction 7. However, in some embodiments, the shaft pressing portion 73 may move by being swung.

Figure 14:
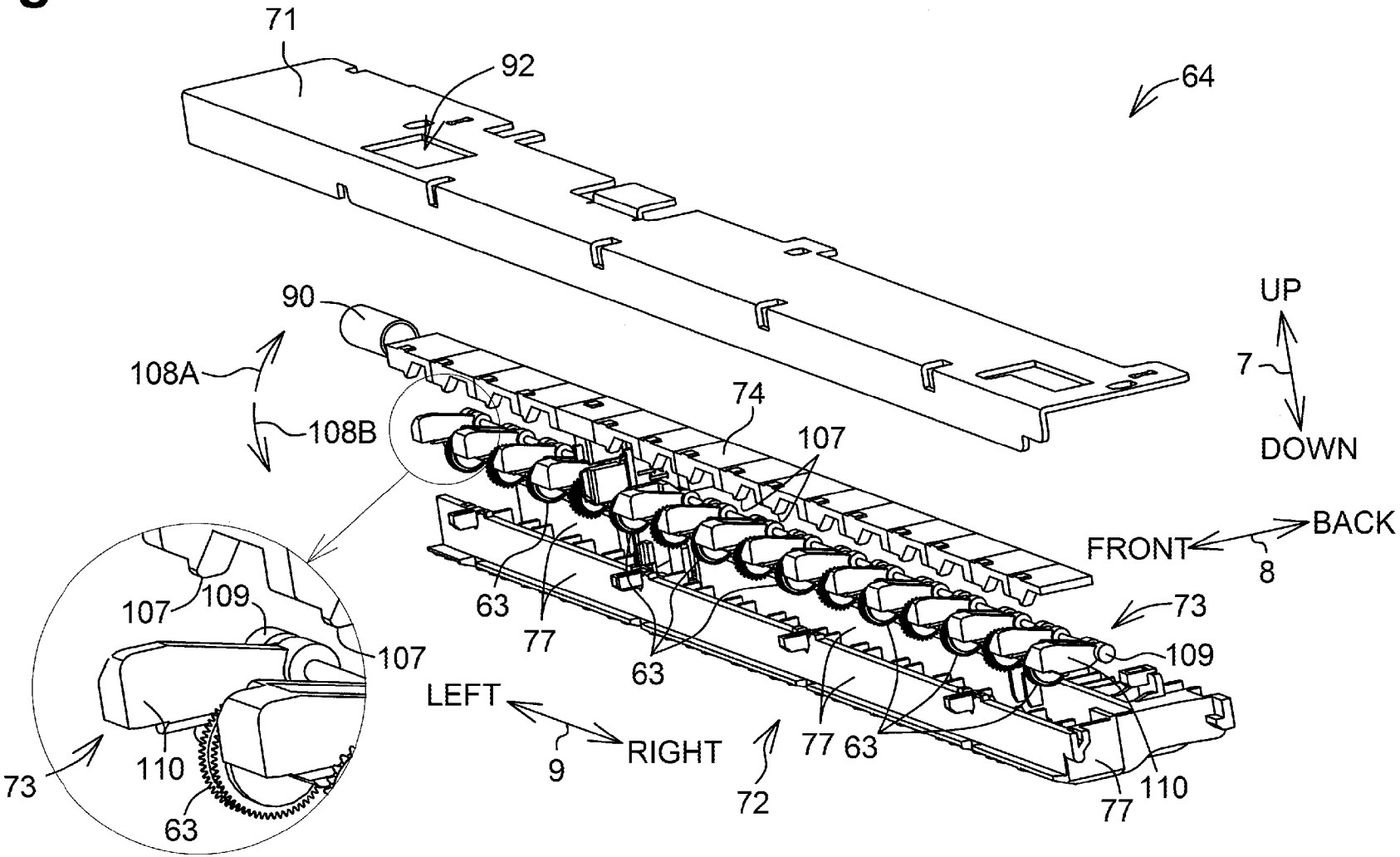
FIG. 14 is an exploded perspective view of the spur moving mechanism in a first variation of the illustrative embodiment according to one or more aspects of the disclosure.
Figure 15:
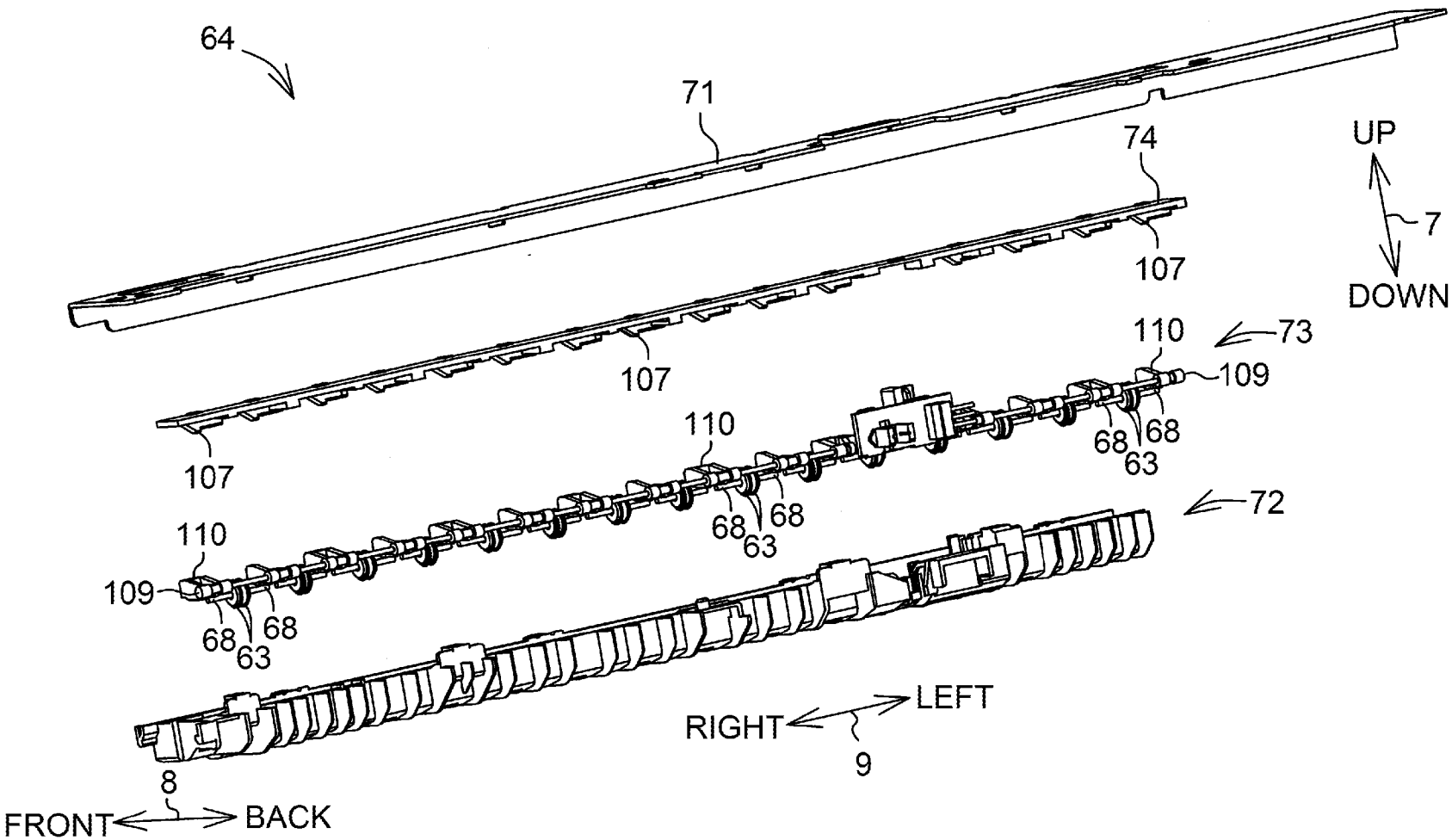
FIG. 15 is another exploded perspective view of the spur moving mechanism in a first variation of the illustrative embodiment according to one or more aspects of the disclosure.

The spur moving mechanism 64 in the first variation is structured so that it partially differs from the spur moving mechanism 64 in the above embodiment. As depicted in FIGS. 14 and 15, the spur moving mechanism 64 has the frame 71, lower cover 72, shaft pressing portions 73, and sliding portion 74. In the spur moving mechanism 64 in the first variation, however, the structures of the shaft pressing portion 73 and sliding portion 74 partially differ from the above embodiment, as described below in detail.

The shaft pressing portion 73 in the first variation may be formed with a shaft 109 extending in the right-left direction 9 and a pivoting portion 110 attached to the shaft 109.

The pivoting portion 110 extends forward from the shaft 109. The top of the pivoting portion 110 in the extending direction may be more forward than the shaft 68 of the spur 63, and in some cases, may be more forward than the spur 63. The shaft 109 is positioned behind the spur 63. That is, the shaft 109 of the shaft pressing portion 73 is disposed on one side (rear side in the first variation) in the conveyance direction 16 relative to the spur 63. Meanwhile, the top of the pivoting portion 110 of the shaft pressing portion 73, that is, the pivoting top, is disposed on the other side (front side in the first variation) in the conveyance direction 16 relative to the spur 63. The position of the pivoting portions 110 in the right-left direction 9 may correspond to the positions of the shafts 68 of each spur 63 in the right-left direction 9. Thus, when the pivoting portion 110 pivots in the direction indicated by the arrow 108B in FIG. 14, a portion behind the pivoting top of the pivoting portion 110 contacts the shaft 68 of the spur 63. The shaft 68 is then pressed by the pivoting top of the pivoting portion 110 and moves downwardly.

In the first variation, a coil spring (not shown) may be attached to the shaft 109. Thus, the shaft 109 may be urged in the direction indicated by the arrow 108A in FIG. 14, which is opposite to the direction indicated by the arrow 108B.

The sliding portion 74 in the first variation may be disposed above the shaft pressing portions 73. A plurality of convex portions 107 (an example of contacting portions), which protrude downwardly, are formed on the lower surface at the front end of the sliding portion 74. The position of the convex portion 107 in the front-back direction 8 is above the top of the pivoting portion 110. That is, the sliding portion 74 is disposed above the tops of the pivoting portions 110. In the right-left direction 9, the convex portion 107 is formed at a position at which the convex portion 107 contacts the top of the pivoting portion 110 when the sliding portion 74 is at the third position but does not contact the top of the pivoting portion 110 when the sliding portion 74 is at the fourth position.

When the sliding portion 74 is at the third position, the convex portion 107 may contact the top of the pivoting portion 110. Thus, the pivoting portion 110 is pressed by the convex portion 107 and pivots in the direction indicated by the arrow 108B against the urging force of the coil spring attached to the shaft 109. When the pivoting portion 110 pivots in the direction indicated by the arrow 108B, a portion slightly behind the pivoting top of the pivoting portion 110 contacts the shaft 68 of the spur 63. The shaft 68 is then pressed by the pivoting top of the pivoting portion 110 and moves downwardly. As a result, the spur 63 presses the discharge roller 62.

When the sliding portion 74 moves from the third position toward the fourth position, the convex portion 107 may move from the position at which the convex portion 107 contacts the pivoting portion 110 to a position at which the convex portion 107 does not contact the pivoting portion 110. Thus, the pivoting portion 110 pivots in the direction indicated by the arrow 108A due to the urging force of the coil spring attached to the shaft 109. When the pivoting portion 110 pivots in the direction indicated by the arrow 108A, the pivoting portion 110 moves away from the shaft 68 of the spur 63. The shaft 68 is no longer pressed by the pivoting top of the pivoting portion 110. As a result, the pressing of the discharge roller 62 by the spur 63 is terminated.

Since in the first variation, the sliding portion 74 may be disposed above the shaft pressing portions 73, when each convex portion 107 on the sliding portion 74 presses the corresponding top of the pivoting portions 110, the force with which the spur 63 presses the discharge roller 62 can be changed. Further, as shown in FIG. 14, the top of the pivoting portion 110 may be on the front side in the conveyance direction 16 relative to the spur 63. The sliding portion 74 may be disposed above the tops of the pivoting portions 110. Therefore, in the first variation, the sliding portion 74 does not need to be disposed immediately above the spurs 63, so the length of the conveying apparatus in the up-down direction 7 can be shortened, enabling the size of the conveying apparatus be reduced. Although FIG. 14 shows the shaft 109 disposed on a rear side of the spur 63 and the pivoting portions 110 extending in the conveyance direction 16, in other embodiments the opposite may be true. That is, the shaft 109 may be disposed on a front side of the spur 63 and the pivoting portions 110 may extend in a direction opposite to the conveyance direction 16, and thus, the sliding portion 74 might still not be disposed immediately above the spurs 63.

In the embodiment described above, the shaft pressing portion 73 may be structured so that when the shaft pressing portion 73 is at the second position, the force with which the spur 63 presses the discharge roller 62 is less than when the shaft pressing portion 73 is at the first position. Further, the shaft pressing portion 73 may be structured so that when the shaft pressing portion 73 is at the second position, the spur 63 moves away from the discharge roller 62.

The spur moving mechanism 64 in the second variation may be structured so that it partially differs from the spur moving mechanism 64 in the above embodiment. FIGS. 10A to 10G illustrate one spur 63 and its peripheral elements of the spur moving mechanism 64 in the second variation. In the second variation as well, the spur moving mechanism 64 has the frame 71, lower cover 72, shaft pressing portions 73, and sliding portion 74. In the spur moving mechanism 64 in the second variation, however, the structures of the frame 71, shaft pressing portion 73, and sliding portion 74 partially differ from the above embodiment, as described below in detail.

In addition to the openings 75 (see FIG. 4), the frame 71 in the second variation may have openings 111. In the second variation, an upper projection 85 formed of the shaft pressing portion 73 may be inserted into the opening 111.

Figures 10A, 10B, 10C, 10D, 10E, 10F, 10G:
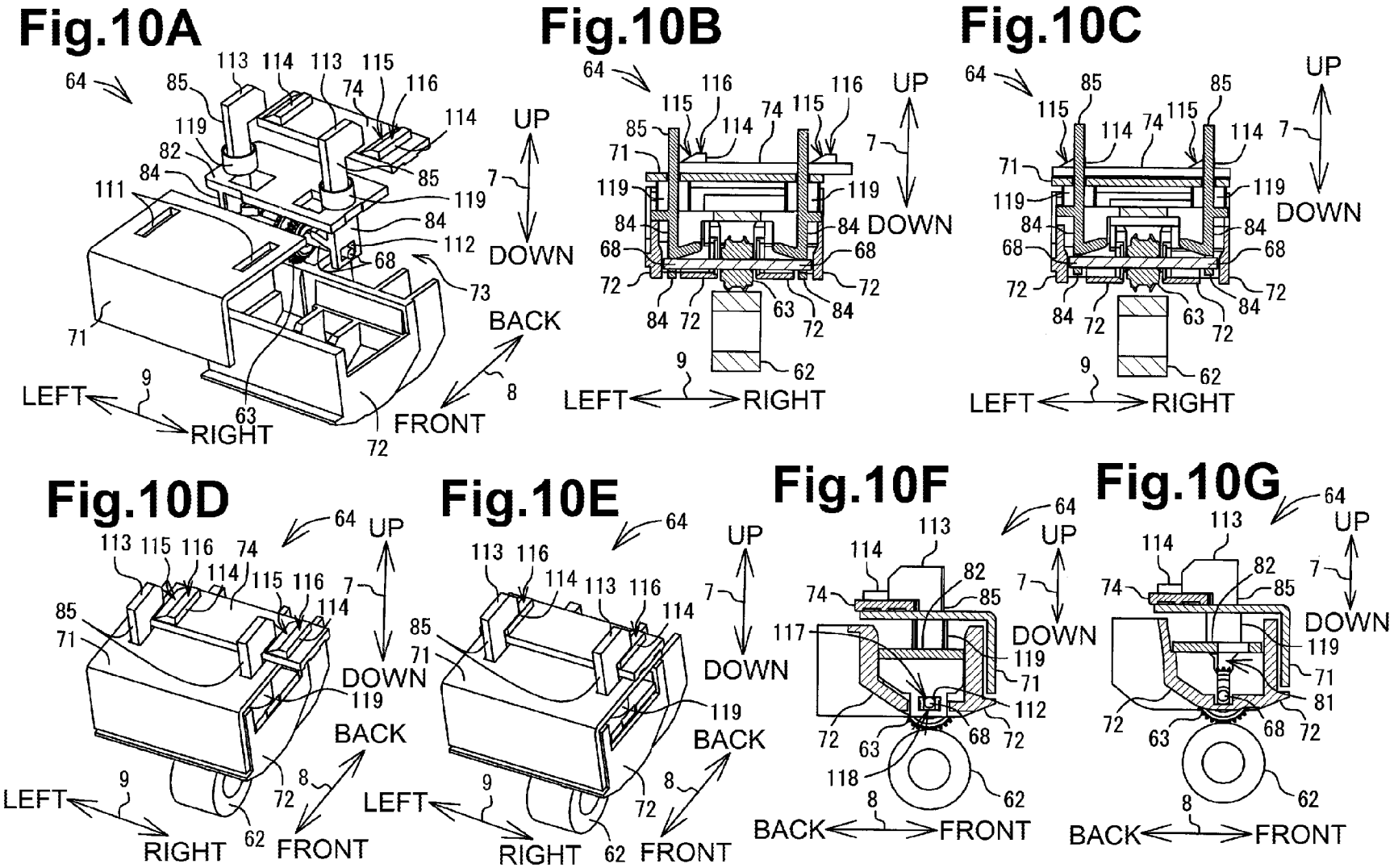
FIGS. 10A to 10G illustrate the spur moving mechanism in a second variation of the illustrative embodiment according to one or more aspects of the disclosure, FIG. 10A being an exploded perspective view, FIG. 10B being a cross-sectional view as taken when the spur moving mechanism is cut at a shaft of a spur when the shaft pressing unit is at the first position, FIG. 10C being a cross-sectional view as taken when the spur moving mechanism is cut at the shaft of the spur when the shaft pressing unit is at the second position, FIG. 10D being a perspective view of the spur moving mechanism when a sliding portion is at a third position, FIG. 10E being a perspective view of the spur moving mechanism when the sliding portion is at a fourth position, FIG. 10F being a cross-sectional view of the spur moving mechanism as taken when the spur moving mechanism is cut at a position at which an opening is visible, FIG. 10G being a cross-sectional view of the spur moving mechanism as taken when the spur moving mechanism is cut at a position at which the slit in an orthogonal direction is visible.

The shaft pressing portion 73 in the second variation may have an opening 112 at the lower end of the lower projection 84 (an example of a roller supporting portion), and the shaft 68 of the spur 63 may be inserted into the opening 112. Thus, the shaft 68 of the spur 63 is rotatably supported by the lower projection 84. The upper projection 85 has a bent portion 113 (an example of a contacted portion), which is bent backwardly, at the top. The lower surface of the bent portion 113 is contacts an upper surface of the sliding portion 74. In the second variation, the sliding portion 74 is supported by the upper surface of the frame 71 as described later (see FIGS. 10D and 10E). As depicted in FIG. 10B, the shaft pressing portion 73 in the second variation is supported by the lower cover 72.

The sliding portion 74 in the second variation has convex portions 114 (an example of contacting portions) on the upper surface instead of the convex portions 86 formed on the lower surface in the embodiment described above. The convex portion 114 protrudes in a direction in which the sliding portion 74 moves away from the spur 63, e.g., upwardly. The convex portion 114 has a third contacting surface 115, which inclines upwardly at an angle from the upper surface of the sliding portion 74, and also has a fourth contacting surface 116, which is contiguous to the third contacting surface 115 and is above the third contacting surface 115, that is, at a position apart from the shaft pressing portion 73. The fourth contacting surface 116 expands in the front-back direction 8 and in the right-left direction 9.

When the lower surface of the bent portion 113 is separated from the convex portion 114 (specifically, the fourth contacting surface 116 of the convex portion 114) of the sliding portion 74 (see FIGS. 10B and 10D), the upper internal surface 117 of the opening 112 formed in the lower projection 84 may contact the shaft 68 of the spur 63 (see FIG. 10F). The shaft 68 of the spur 63 may be pressed downwardly by the upper internal surface 117 of the opening 112. Thus, the spur 63 presses the discharge roller 62. At that time, as depicted in FIG. 10B, the lower projection 84 contacts the lower cover 72. The sliding portion 74 in FIGS. 10B, 10D, and 10F is at the third position. At that time, the shaft pressing portion 73 is at the first position.

When the sliding portion 74 moves to the left from the position indicated in FIG. 10B, the convex portion 114 of the sliding portion 74 may contact the bent portion 113 of the upper projection 85 of the shaft pressing portion 73 from below. Specifically, the third contacting surface 115 of the convex portion 114 of the sliding portion 74, which slides to the left, first contacts the bent portion 113. As the sliding portion 74 slides to the left, the bent portion 113 is pressed by the third contacting surface 115, which is an inclined surface, and moves upwardly. Finally, the fourth contacting surface 116 of the convex portion 114 contacts the bent portion 113 as depicted in FIGS. 10C and 10E.

Since the bent portion 113, in other words, the shaft pressing portion 73, moves upwardly, the upper internal surface 117 of the opening 112 formed in the lower projection 84 on the shaft pressing portion 73 moves away from the shaft 68 of the spur 63. At the same time, the lower internal surface 118 (see FIG. 10F) of the opening 112 contacts the shaft 68 of the spur 63. The shaft 68 of the spur 63 is pressed upwardly by the lower internal surface 118 of the opening 112. The spur 63 thereby moves away from the discharge roller 62 (see FIG. 10C). At that time, the lower projection 84 is separated from the lower cover 72 as depicted in FIG. 10C. The sliding portion 74 in FIGS. 10C and 10E is at the fourth position. At that time, the shaft pressing portion 73 is at the second position.

Thus, the convex portion 114 may be formed at a position at which the convex portion 114 contacts the bent portion 113 when the sliding portion 74 is at the third position but does not contact the bent portion 113 when the sliding portion 74 is at the fourth position. When the bent portion 113 is pressed by the convex portion 114, which has contacted the bent portion 113, the shaft pressing portion 73 moves from the first position to the second position.

In the second variation, a coil spring 119 (an example of a first urging member) may be provided between the frame 71 and the shaft pressing portion 73 as depicted in FIG. 10A. The coil spring 119 may be disposed in a state in which the coil spring 119 is inserted into the upper projection 85, which extends in the up-down direction 7. The upper end of the coil spring 119 may be connected to the frame 71 and its lower end may be connected to the lower projection 84 of the shaft pressing portion 73. Although in the second variation, the lower end of the coil spring 119 is connected through the plate-like member 82 to the lower projection 84, the lower end may be connected directly to the lower projection 84.

The coil spring 119 may be disposed in a state in which it is compressed. Thus, the coil spring 119 may urge the lower projection 84 of the shaft pressing portion 73 downwardly, that is, toward the lower cover 72.

In the second variation, when the sliding portion 74 moves from the third position to the fourth position in the right-left direction 9, the spur 63 can be separated from the discharge roller 62. When the spur 63 is separated as described above, the lower cover 72 and the frame 71 to which the lower cover 72 is attached are not moved. Accordingly, it is possible to suppress the size of the all-in-one machine 10 in which the conveying apparatus is mounted from being enlarged. It is also possible to reduce power required to move the spur 63. Accordingly, the second variation can move the spur 63 without having to move the lower cover 72 and the frame 71 to which the lower cover 72 is attached.

In the second variation, the sliding portion 74 may contact the bent portion 113 of the shaft pressing portion 73. When the sliding portion 74 moves from the third position to the fourth position and the convex portion 114 of the sliding portion 74 thereby contacts the bent portion 113, the shaft pressing portion 73 is pressed by the convex portion 114 and moves from the first position to the second position. The spur 63 is supported by the lower projection 84 of the shaft pressing portion 73. Therefore, during the movement of the shaft pressing portion 73 from the first position to the second position, the spur 63 moves in a direction in which it is separated from the discharge roller 62 while being supported by the lower projection 84, which also moves. Thus, when the sliding portion 74 moves, the second variation enables the shaft pressing portion 73 to move between the first position and the second position and also enables the spur 63 to move toward and away from the discharge roller 62. That is, by the movement of the sliding portion 74, the second variation enables the spur 63 to move toward and away from the discharge roller 62.

Since the lower projection 84 of the shaft pressing portion 73 is urged toward the discharge roller 62, that is, downwardly, the second variation enables the lower projection 84 of the shaft pressing portion 73 to be positioned with respect to the lower cover 72 with high precision in a state in which the lower projection 84 of the shaft pressing portion 73 contacts the lower cover 72.

Figure 11:
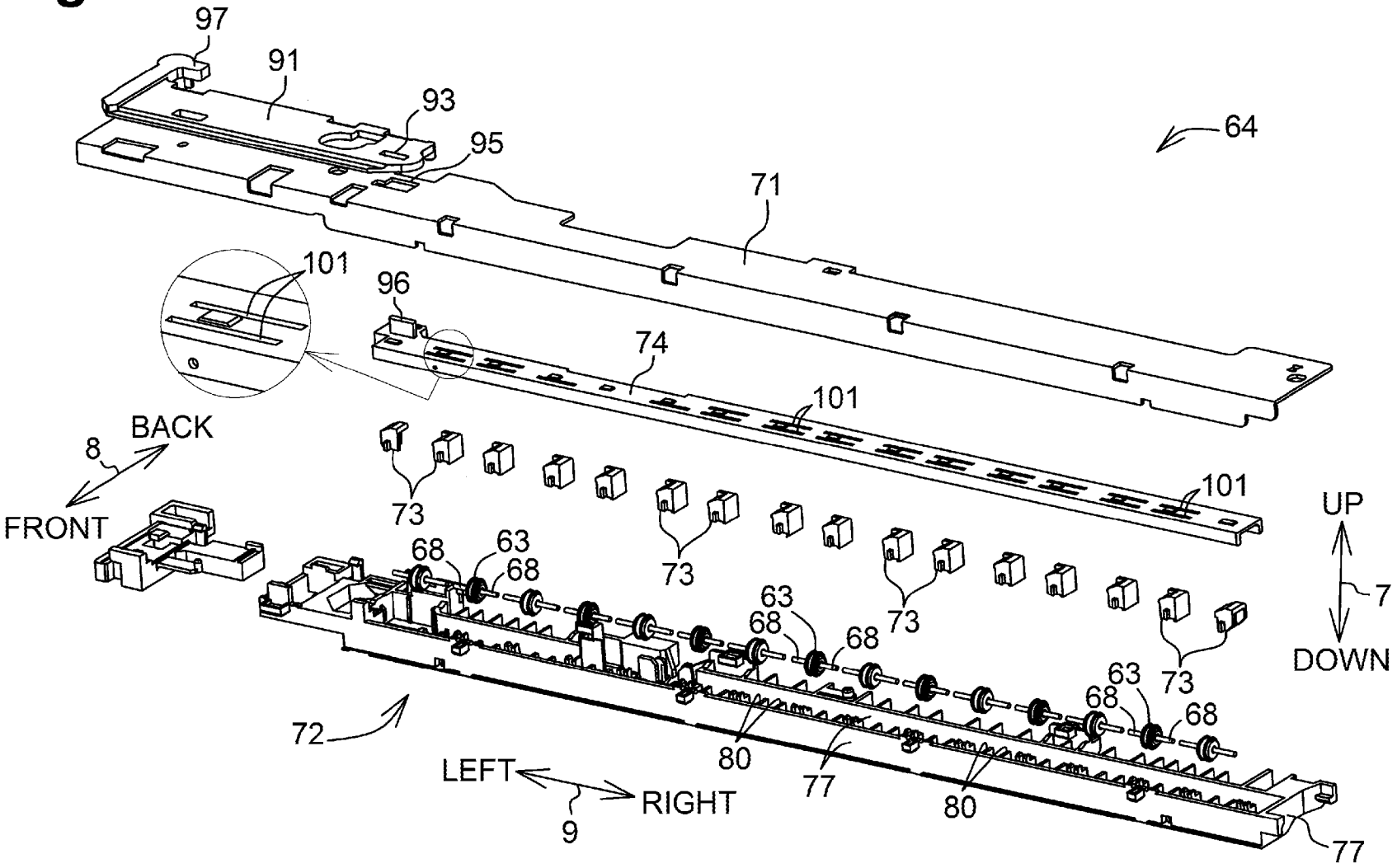
FIG. 11 is an exploded perspective view of the spur moving mechanism in a third and sixth variation of the illustrative embodiment according to one or more aspects of the disclosure.

In the third variation, although, in the embodiments described above, the sliding portion 74 may have had the thin portion 99 and thick portion 100, the sliding portion 74 may have slits 101 extending in the right-left direction 9 instead of the thin portion 99 and thick portion 100 or besides the thin portion 99 and thick portion 100, as depicted in FIG. 11.

Figure 12:
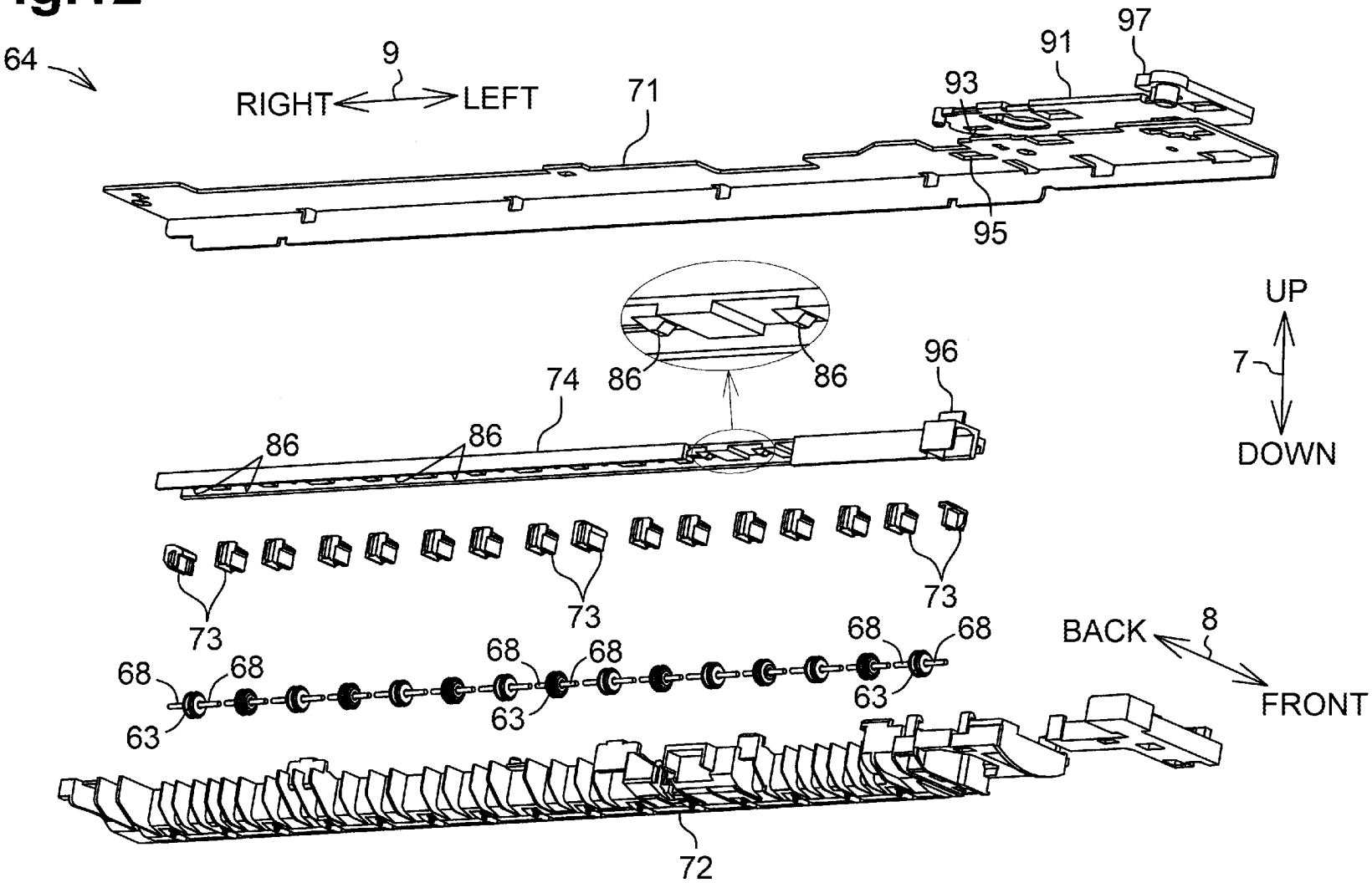
FIG. 12 is another exploded perspective view of the spur moving mechanism in third and sixth variations in a third and sixth variation of the illustrative embodiment according to one or more aspects of the disclosure.

As with the concave portion 98, it suffices for each slit 101 to be formed at a similar position as a portion at which at least the sliding portion 74 and shaft pressing portion 73 mutually contact in the right-left direction 9. The reason for this is similar as for the concave portion 98. In the third variation, the slit 101 is formed at a similar position as a portion at which the sliding portion 74 and shaft pressing portion 73 mutually contact in the right-left direction 9, specifically, at which the convex portion 86 (see FIG. 12) is formed. In the third variation, sliding portions 74 may be disposed on the front side and back side of the convex portion 86 in the front-back direction 8, that is, on both sides of the convex portion 86. Of course, the sliding portion 74 may be formed on only one side of the portion.

In the third variation, a periphery of each slit 101 may have a relatively short length in the conveyance direction 16. Accordingly, areas of the sliding portion 74 near the slits 101 (and therefore near the convex portions 86) may be more flexible than areas of the sliding portion 74 farther from the slits 101. The combination of the sliding portion 74, having slits 101, and the frame 71, which may reduce (or prevent) the sliding portion 74 from becoming deformed, can increase the positional precision of the spur 63.

In the third variation, the periphery of slits 101 that are formed at both ends of the convex portion 86, which is a portion at which the sliding portion 74 and shaft pressing portion 73 mutually contact in the front-back direction 8, may have a further shorter length in the conveyance direction 16 than when the slit 101 is formed on only one side of the convex portion 86. Accordingly, areas of the sliding portion 74 near the slits 101 (and therefore near the convex portions 86) may be more flexible than areas of the sliding portion 74 farther from the slits 101. The combination of the sliding portion 74, having slits on both sides of the convex portion 86, and the frame 71, which may reduce (or prevent) the sliding portion from becoming deformed, may enable the positional precision of the spur 63 to be further higher than when the slit 101 is formed on only one side of the convex portion 86.

In the embodiments described above, the shaft pressing portion 73 has been supported by the sliding portion 74 at the first position and second position. However, in a fourth variation of the embodiment, the shaft pressing portion 73 may be supported by the sliding portion 74 at three or more positions.

Figure 16A:
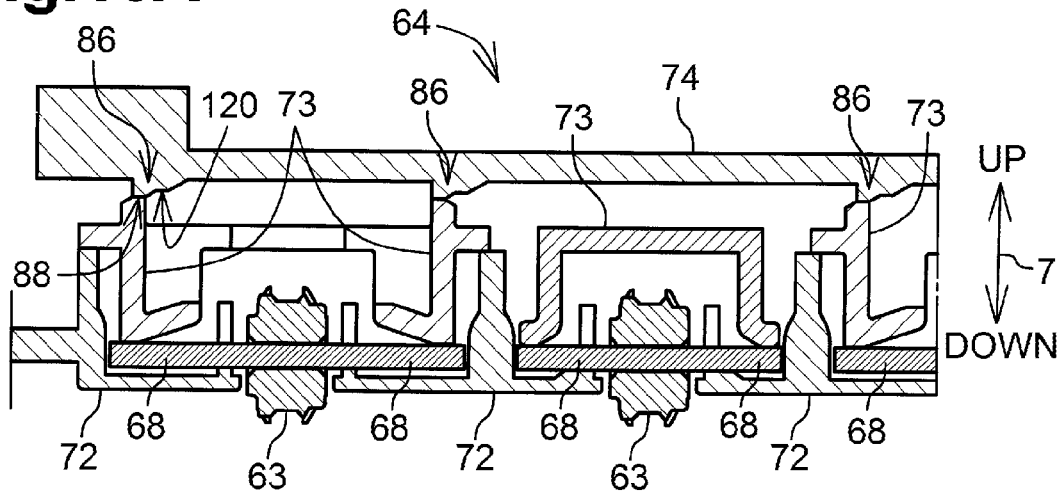
FIGS. 16A, 16B, and 16C are cross-sectional views taken when the spur moving mechanism is cut at the shaft of the spur in a first variation of the illustrative embodiment according to one or more aspects of the disclosure.
Figure 16B:
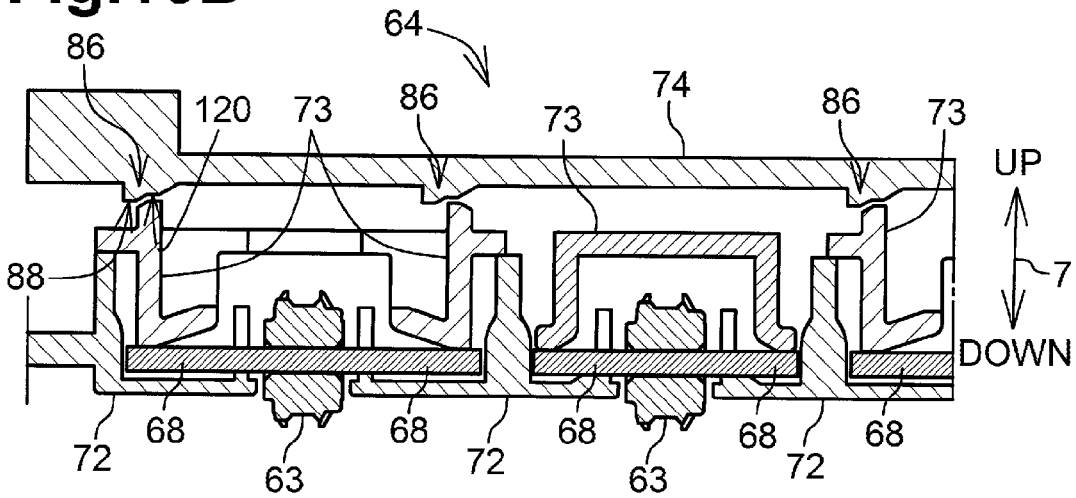
Figure 16C:
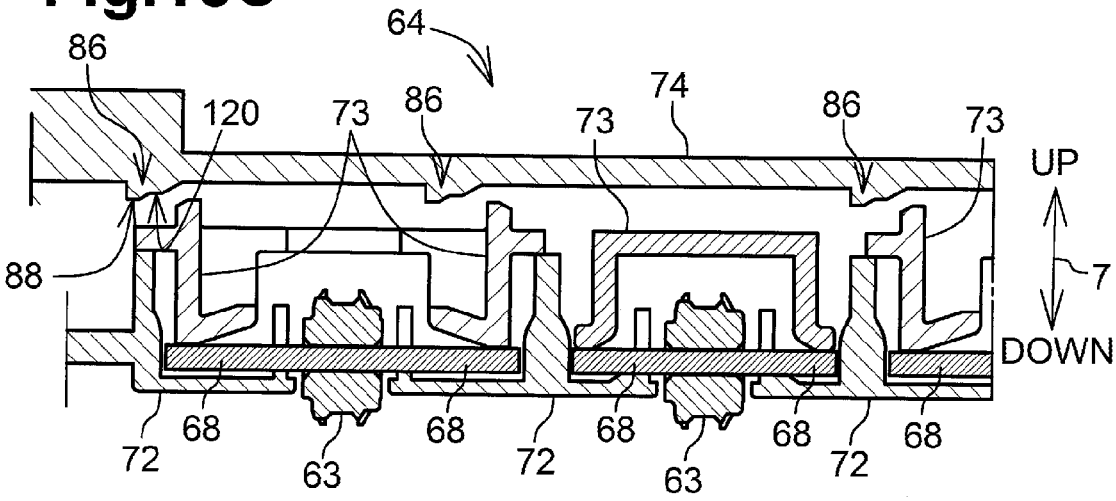

For example, as depicted in FIGS. 16A to 16C, the convex portion 86 formed on the lower surface of the sliding portion 74 may have a fifth contacting surface 120 (an example of a second contacting portion) between the second contacting surface 88 (an example of a first contacting portion) and the lower surface of the sliding portion 74. The fifth contacting surface 120 is disposed above the second contacting surface 88 and below the lower surface of the sliding portion 74. An inclined surface is formed between the fifth contacting surface 120 and the second contacting surface 88 to link them. Another inclined surface is also formed between the fifth contacting surface 120 and the lower surface of the sliding portion 74 to link them.

As described in the above embodiment, in a state in which the second contacting surface 88 and the upper projection 85 of the shaft pressing portion 73 mutually contact, the sliding portion 74 may be at the third position and the shaft pressing portion 73 may be at the first position (see FIG. 16A). In a state in which the lower surface of the sliding portion 74 and the upper projection 85 of the shaft pressing portion 73 mutually contact, the sliding portion 74 is at the fourth position and the shaft pressing portion 73 is at the second position (see FIG. 16C).

In a process to shift from the state in FIG. 16A to the state in FIG. 16C or a process to shift from the state in FIG. 16C to the state in FIG. 16A, the fifth contacting surface 120 and upper projection 85 of the shaft pressing portion 73 may mutually contact (see FIG. 16B). Thus, the shaft pressing portion 73 can be held at three positions by the sliding portion 74.

In a state in which the fifth contacting surface 120 and the upper projection 85 of the shaft pressing portion 73 mutually contact, the fifth contacting surface 120 may be farther away from the spur 63 than the second contacting surface 88 is, so the force with which the shaft pressing portion 73 presses the shaft 68 of the spur 63 may be less than when the shaft pressing portion 73 is at the first position. In that state, the fifth contacting surface 120 may be closer to the spur 63 than the lower surface of the sliding portion 74 is, so the force with which the shaft pressing portion 73 presses the shaft 68 of the spur 63 may be greater than when the shaft pressing portion 73 is at the second position.

Although, in the example depicted in FIGS. 16A to 16C, the fifth contacting surface 120 is formed on the convex portion 86 in the embodiment described above, a similar structure can be used in the second variation as well. For example, it suffices for a contacting surface that is similar to the fifth contacting surface 120 described above to be formed on the convex portion 114 in FIGS. 10A to 10G. The contacting surface is positioned above the upper surface of the sliding portion 74 and below the fourth contacting surface 116 and is contiguous to the upper surface of the sliding portion 74 and to the fourth contacting surface 116 through inclined surfaces.

In this case, in a state in which the contacting surface and the bent portion 113 of the upper projection 85 of the shaft pressing portion 73 mutually contact, the contacting surface may be closer to the spur 63 than the fourth contacting surface 116 is, so the distance between the spur 63 and the discharge roller 62 is larger than when the shaft pressing portion 73 is at the first position. In this state, the contacting surface is more away from the spur 63 than the lower surface of the sliding portion 74 is, so the distance between the spur 63 and the discharge roller 62 is smaller than when the shaft pressing portion 73 is at the second position.

Although, in the above example, the shaft pressing portion 73 has been capable of being held at three positions by the sliding portion 74, the shaft pressing portion 73 may be capable of being held at four or more positions. In this case, it suffices for two or more contacting surfaces to be formed between the second contacting surface 88 or fourth contacting surface 116 and the upper surface or lower surface of the sliding portion 74.

As described above, in addition to the first position and second position, the shaft pressing portion 73 can move to a prescribed position at which the force with which the spur 63 presses the shaft 68 is smaller than when the shaft pressing portion 73 is at the first position but larger than when the shaft pressing portion 73 is at the second position or to a prescribed position at which the spur 63 is more away from the discharge roller 62 than when the shaft pressing portion 73 is at the first position but closer to the discharge roller 62 than when the shaft pressing portion 73 is at the second position. The closer to the second position the prescribed position is, the smaller the above pressing force is. Alternatively, the closer the prescribed position is to the second position, the larger the distance of the spur 63 from the discharge roller 62 is.

The fourth variation can change the force with which the spur 63 presses the discharge roller 62 and the position of the spur 63 with respect to the discharge roller 62 according to, for example, the type of recording sheet 12.

In the embodiment described above, when moving from the first position to the second position, shaft pressing portions 73 have changed the force with which the spur 63 presses the discharge roller 62 or the distance of the spur 63 from the discharge roller 62 for all of the plurality of spurs 63. However, in the firth variation, shaft pressing portions 73 may be provided for a subset of the plurality of spurs 63. In the above embodiment and second variation, for example, convex portions 86 or convex portions 114 have been provided in correspondence to all of the plurality of spurs 63. However, convex portions 86 or convex portions 114 may be provided in correspondence to only, e.g., odd-numbered spurs 63 counted from the left end of all of the plurality of spurs 63.

In this case, when the shaft pressing portion 73 moves from the first position to the second position, the force with which the spur 63 presses the discharge roller 62 or the distance of the spur 63 from the discharge roller 62 is changed by the shaft pressing portion 73 for a subset of the plurality of spurs 63, while a greater pressing force or shorter distance remain unchanged for the rest of the plurality of spurs 63.

When, for example, shaft pressing portions 73 are provided in correspondence to only odd-numbered spurs 63 counted from the end in the right-left direction 9, the fifth variation can make the recording sheet 12 wavy in the right-left direction 9, increasing the stiffness of the recording sheet 12.

In the embodiment described above, a plurality of shaft pressing portions 73 have been attached to a single plate-like member 82. However, in a sixth variation, shaft pressing portions 73 may be separately disposed.

Figures 13A, 13B, 13C:
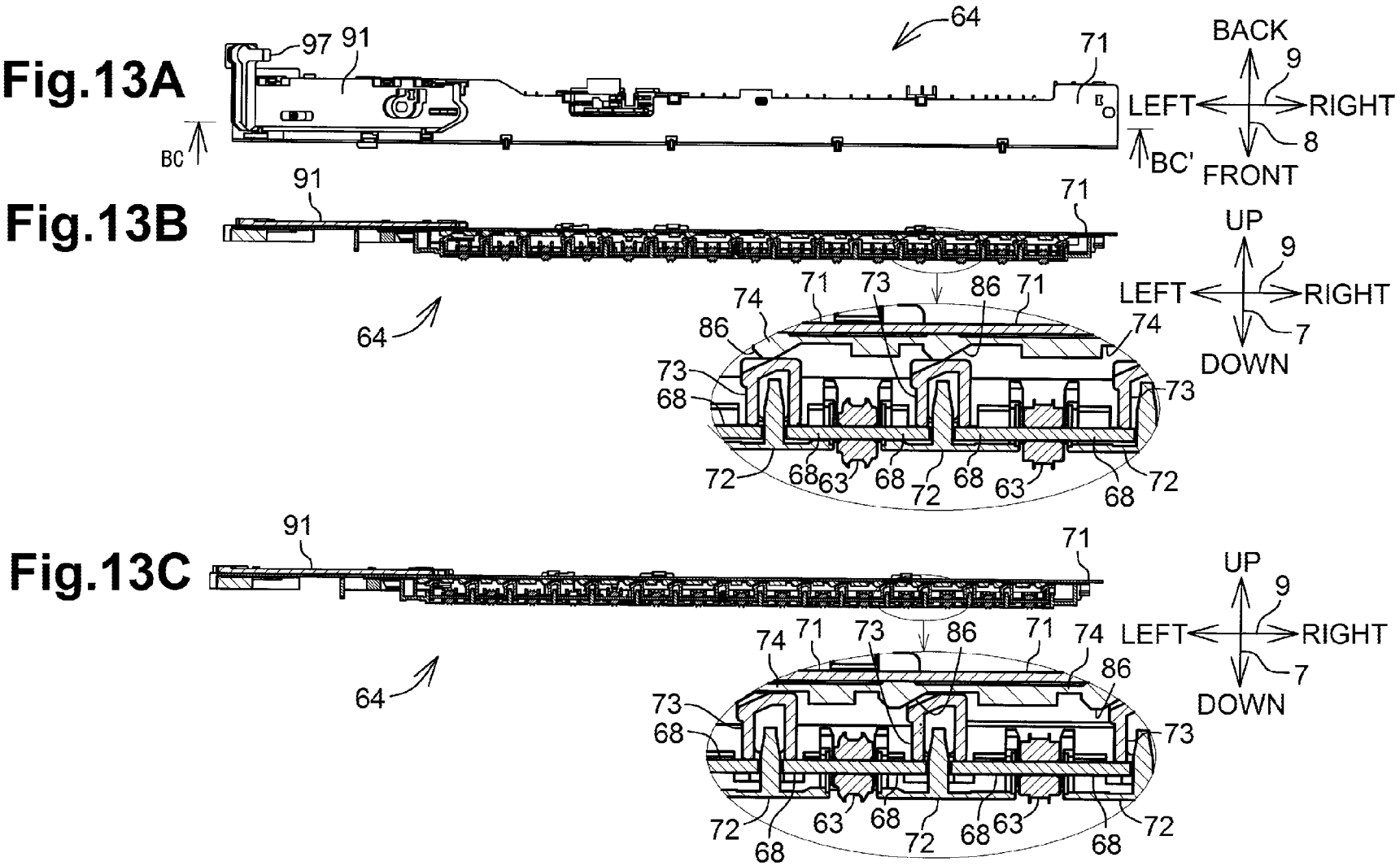
FIG. 13A is a plan view of the spur moving mechanism in a third and sixth variation of the illustrative embodiment according to one or more aspects of the disclosure.
FIG. 13B is a cross-sectional view as taken along line BC-BC' in FIG. 13A when the shaft pressing unit is at the first position.
FIG. 13C is a cross-sectional view as taken along line BC-BC' in FIG. 13A when the shaft pressing unit is at the second position.

For example, as depicted in FIG. 11 to FIGS. 13A to 13C, each shaft pressing portion 73 may press the shaft 68 extending from the left side of one spur 63 and the shaft 68 extending from the right side of a spur 63 next to the one spur 63 to the left (e.g., a neighboring spur 63). In this case, each shaft pressing portion 73 is positioned between the relevant two spurs 63 in the right-left direction 9 and across the two axes 68 present between the two spurs 63. FIG. 13B illustrates a state in which the shaft pressing portion 73 is at the first position and FIG. 13C illustrates a state in which the shaft pressing portion 73 is at the second position.

In other words, in the sixth variation, the shaft pressing portion 73 may press a shaft 68 extending from one side of a certain spur 63 of the plurality of spurs 63 and another shaft 68 extending from one side of a spur 63 adjacent to the certain spur 63 toward the certain spur 63.

In the sixth variation, the shaft pressing portion 73 does not need to be disposed immediately above the spurs 63, so the length of the conveying apparatus in the up-down direction 7 can be shortened, enabling the size of the conveying apparatus to be reduced.

What is claimed is:

1. A conveying apparatus comprising:

a plurality of first rollers spaced from each other with respect to a width direction orthogonal to a conveyance direction, each of the first rollers comprising a respective shaft;

a second roller configured to form a nip point with each of the first rollers and to convey a sheet in the conveyance direction; and a roller holder configured to support the first roller and allow the plurality of first rollers to move toward and away from the second roller, the roller holder comprising:

a shaft pressing portion configured to move between a first position in which the shaft pressing portion presses one or more of the shafts of the plurality of first rollers toward the second roller, and a second position in which a pressing force of the shaft pressing portion acting on the one or more shafts of the plurality of first rollers is less than a pressing force of the shaft pressing portion acting on the one or more shafts of the plurality of first rollers when the shaft pressing portion is located in the first position, a sliding portion configured to contact the shaft pressing portion and move in the width direction between a third position and a fourth position, and a roller housing in which the plurality of first rollers are disposed, the roller housing supporting the shaft pressing portion and the sliding portion, wherein, when the sliding portion moves from the third position to the fourth position, the shaft pressing portion moves from the first position to the second position, and wherein, when the sliding portion moves from the fourth position to the third position, the shaft pressing portion moves from the second position to the first position.

2. The conveying apparatus according to claim 1, wherein the sliding portion comprises a contacting portion that protrudes toward the shaft pressing portion; and wherein the contacting portion is disposed at a position that contacts the shaft pressing portion when the sliding portion is at the third position, and does not contact the shaft pressing portion when the sliding portion is at the fourth position.

3. The conveying apparatus according to claim 2, wherein, when the shaft pressing portion is at the first position, one or more of the first rollers press the second roller; and wherein, when the shaft pressing portion is at the second position, a pressing force of the plurality of first rollers applied to the second roller is less than when the shaft pressing portion is at the first position.

4. The conveying apparatus according to claim 2, wherein the shaft pressing portion is configured to pivot about a shaft that is disposed on one side of the plurality of first rollers with respect to the conveyance direction;

wherein a top of the shaft pressing portion is disposed at another side of the plurality of first rollers with respect to the conveyance direction;

wherein the sliding portion is disposed above the top of the shaft pressing portion; and wherein the contacting portion contacts the top of the shaft pressing portion when the sliding portion is at the third position, and does not contact the top of the shaft pressing portion when the sliding portion is at the fourth position.

5. The conveying apparatus according to claim 2, wherein the roller holder comprises a metal frame in a flat plate shape and extends in the width direction;

wherein the sliding portion is supported by the roller holder when in contact with the frame, and the sliding portion having a first thickness portion and a second thickness portion, wherein a width of the second thickness portion is thicker than a width of the first thickness portion in an approaching-separating direction; and wherein the contacting portion is disposed on the first thickness portion.

6. The conveying apparatus according to claim 2, wherein the roller holder comprises a metal frame in a flat plate shape and extends in the width direction;

wherein the sliding portion is supported by the roller holder when in contact with the frame; and wherein the sliding portion has a slit that extends along the width direction and at a position corresponding to a position of the contacting portion.

7. The conveying apparatus according to claim 6, wherein the sliding portion has slits that are formed on both sides of the contacting portion with respect to the conveyance direction.

8. The conveying apparatus according to claim 2, wherein the contacting portion comprises a first contacting portion that contacts the shaft pressing portion at the first position and a second contacting portion that contacts the shaft pressing portion at a position between the first position and the second position with respect to an approaching-separating direction; and wherein a protrusion of the second contacting portion is smaller than a protrusion of the first contacting portion.

9. The conveying apparatus according to claim 1, wherein the sliding portion comprises a contacting portion that protrudes away from the plurality of first rollers;

wherein the shaft pressing portion comprises a roller supporting portion that supports the shafts of the plurality of first rollers and comprises a contacted portion that contacts the contacting portion when the sliding portion is at the fourth position and does not contact the contacting portion when the sliding portion is at the third position;

wherein when the shaft pressing portion is at the first position, the first rollers press the second roller; and wherein when the shaft pressing portion is at the second position, the first rollers move away from the second roller.

10. The conveying apparatus according to claim 9, comprising:

a first urging member disposed between the sliding portion and the roller supporting portion, wherein the first urging member urges the roller supporting portion toward the second roller.

11. The conveying apparatus according to claim 1, wherein the roller housing comprises a bottom plate and side plates;

wherein the bottom plate has an opening to expose the plurality of first rollers; and wherein the side plates are erected from the bottom plate and are disposed outside of the plurality of first rollers and the shaft pressing portion with respect to the width direction.

12. The conveying apparatus according to claim 1, wherein the roller housing comprises bearings, which each include a slit extending in an approaching-separating direction; and wherein the shafts of the plurality of first rollers are inserted into the bearings.

13. The conveying apparatus according to claim 1, wherein the shaft pressing portion is configured to press every other shaft of the plurality of first rollers with respect to the width direction.

14. The conveying apparatus according to claim 1, wherein the shafts of a pair of adjacent first rollers of the plurality of first rollers extend to each other with respect to the width directional;

wherein the shaft pressing portion comprises a plurality of lower projections; and wherein at least one of the lower projections of the shaft pressing portion is configured to press both shafts of adjacent first rollers.

15. The conveying apparatus according to claim 1, wherein the shafts of the plurality of first rollers are elastic.

16. An image recording apparatus comprising:

a plurality of first rollers spaced from each other with respect to a width direction orthogonal to a conveyance direction, each of the first rollers comprising a respective shaft;

a second roller configured to form a nip point with each of the first rollers and to convey a sheet in the conveyance direction;

a recording portion configured to record an image on the sheet to be conveyed by the first rollers and the second roller; and a roller holder configured to support the first roller and allow the plurality of first rollers to move toward and away from the second roller, the roller holder comprising:

a shaft pressing portion configured to move between a first position in which the shaft pressing portion presses one or more of the shafts of the plurality of first rollers toward the second roller, and a second position in which a pressing force of the shaft pressing portion acting on the one or more shafts of the plurality of first rollers is less than a pressing force of the shaft pressing portion acting on the one or more shafts of the plurality of first rollers when the shaft pressing portion is located in the first position, a sliding portion configured to contact the shaft pressing portion and move in the width direction between a third position and a fourth position, and a roller housing in which the plurality of first rollers are disposed, the roller housing supporting the shaft pressing portion and the sliding portion, wherein when the sliding portion moves from the third position to the fourth position, the shaft pressing portion moves from the first position to the second position, and wherein when the sliding portion moves from the fourth position to the third position, the shaft pressing portion moves from the second position to the first position.

17. The image recording apparatus according to claim 16, comprising:

a second urging member that urges the sliding portion toward the third positional;

wherein the recording portion comprises a recording head that ejects ink droplets toward the sheet and a carriage on which the recording head is mounted, wherein the carriage is configured to move in the width direction; and wherein the carriage causes the sliding portion to move from the third position to the fourth position.

18. The image recording apparatus according to claim 16, wherein the sliding portion comprises a contacting portion that protrudes toward the shaft pressing portion; and wherein the contacting portion is disposed at a position that contacts the shaft pressing portion when the sliding portion is at the third position, and does not contact the shaft pressing portion when the sliding portion is at the fourth position.

19. The image recording apparatus according to claim 16, wherein the shafts of the plurality of first rollers are elastic.

20. The image recording apparatus according to claim 16, wherein the roller housing comprises a bottom plate and side plates;

wherein the bottom plate has an opening to expose the plurality of first rollers; and wherein the side plates are erected from the bottom plate and are disposed outside of the plurality of first rollers and the shaft pressing portion with respect to the width direction.

* * * * *